US012768159B2

(12) United States Patent
Vittadini et al.

(10) Patent No.: US 12,768,159 B2
(45) Date of Patent: Oct. 20, 2026

(54) MOUNTING SYSTEM FOR BUILDING PANELS

(71) Applicant: ASSEMBLY OSM, INC., New York, NY (US)

(72) Inventors: Andrea Vittadini, Brooklyn, NY (US); Alessandro Massarotto, Villorba (IT); Marco Zardetto, Santa Lucia di Piave (IT); Luca Andreetta, Silea (IT); Sameer Kumar, New York, NY (US); Matt Kirkham, New York, NY (US)

(73) Assignee: PALM DREAMSCAPES QOZB, LLC, Austin, TX (US)

( * ) Notice: Subject to any disclaimer, the term of this patent is extended or adjusted under 35 U.S.C. 154(b) by 359 days.

(21) Appl. No.: 18/596,382

(22) Filed: Mar. 5, 2024

(65) Prior Publication Data

US 2024/0247480 A1 Jul. 25, 2024

Related U.S. Application Data

(63) Continuation of application No. 18/043,993, filed as application No. PCT/US2021/071403 on Sep. 9, 2021, now Pat. No. 11,933,039.

(60) Provisional application No. 63/075,979, filed on Sep. 9, 2020.

(51) Int. Cl.
*E04B 1/38* (2006.01)
*E04B 1/348* (2006.01)

(52) U.S. Cl.
CPC ..... *E04B 1/388* (2023.08); *E04B 1/3483* (2013.01)

(58) Field of Classification Search
CPC ..... E04B 1/388; E04B 1/3483; E04B 2/88; E04B 2/885; E04B 2/965; E04B 2/90; E04B 2/96; E04B 2/962; E04B 2/967; F16B 2200/99; F16B 5/0032
USPC ..... 52/235, 506.1, 509, 510, 745.03, 747.1; 248/220.21, 220.22, 221.11, 222.52
See application file for complete search history.

(56) References Cited

U.S. PATENT DOCUMENTS 2,996,845 A * 8/1961 Cipriani ..... E04B 2/90 52/475.1
3,504,465 A * 4/1970 Brinker ..... E04B 2/962 52/584.1
3,509,672 A * 5/1970 Brooks ..... E04B 2/96 52/235
3,715,848 A * 2/1973 Jordan ..... E06B 1/6046 52/235
3,866,374 A * 2/1975 Dallen ..... E04B 2/967 52/204.593
4,546,582 A * 10/1985 Gartner ..... E04B 2/90 52/475.1

(Continued)

*Primary Examiner* — Brian E Glessner
*Assistant Examiner* — Adam G Barlow
(74) *Attorney, Agent, or Firm* — Gottlieb, Rackman & Reisman, PC

(57) ABSTRACT

A mounting and alignment system for building panels. A mullion guides one edge of a first panel mounted on a structure interacts with a mullion guide on an adjacent edge of second panel to be mounted next to the first. The mullion guides engage and interact as the second panel is lowed in place to adjust the horizontal position of the second panel relative to the first to a small tolerance suitable for other interacting panel structures. After the second panel is installed, mullion guides on the adjacent panel edges can be removed.

19 Claims, 30 Drawing Sheets

(56) References Cited

U.S. PATENT DOCUMENTS

| | | | | | |
|---|---|---|---|---|---|
| 5,046,293 | A * | 9/1991 | Kajiura | E06B 1/6015 | 52/235 |
| 5,054,985 | A * | 10/1991 | Wagatsuma | E04G 21/167 | 52/745.1 |
| 5,381,637 | A * | 1/1995 | Farag | E06B 3/5427 | 52/204.593 |
| 5,537,766 | A * | 7/1996 | Nickens | G09F 15/0068 | 40/605 |
| 12,497,780 | B2 * | 12/2025 | White | E04B 2/92 | |
| 2008/0101883 | A1 * | 5/2008 | Derecktor | B60P 7/0815 | 248/220.21 |
| 2014/0013685 | A1 * | 1/2014 | Coleman | E05F 15/605 | 52/235 |
| 2014/0301767 | A1 * | 10/2014 | Cohen | F16B 5/02 | 403/13 |
| 2015/0240505 | A1 * | 8/2015 | Blinn | E04G 21/3204 | 182/112 |
| 2018/0180077 | A1 * | 6/2018 | White | A47G 1/065 | |
| 2019/0093416 | A1 * | 3/2019 | Luvison | E06B 1/524 | |
| 2019/0100913 | A1 * | 4/2019 | Doyon | E04B 2/885 | |
| 2023/0235550 | A1 * | 7/2023 | Long | E04B 1/388 | 52/235 |

* cited by examiner

MOUNTING SYSTEM FOR BUILDING PANELS

CROSS REFERENCE TO RELATED CASES

This application is a continuation of U.S. patent application Ser. No. 18/043,993, filed Mar. 3, 2023, and which is a U.S. National Phase of PCT Application No. PCT/US2021/071403, filed Sep. 9, 2021, and which claims priority to U.S. Provisional Patent Application No. 63/075,979 filed Sep. 9, 2020, the entire contents of which is expressly incorporated by reference.

FIELD OF THE INVENTION

The present invention is directed to structures for mounting and aligning panels to prefabricated building modules and other building structures.

BACKGROUND

Curtain wall systems are commonly used for high rise buildings. A curtain wall is a non-load bearing facade that is attached to the outside of the building. Curtain walls are generally comprised of panels that are separately mounted to the building structure. The panels can have various designs and may have a solid surface or include window components. Various mounting hardware exists for hanging the panels from the load bearing building structure and transferring the load of the panel to the load bearing building structure, such as the floors or other structural framing.

Curtain wall systems must perform various functions, including providing an air, water and thermal barrier. To achieve this, the fit between adjacent panels must be very accurate, often with a tolerance on the order of 1 mm. When mounting panels on-site to an existing building structure, workers manually lower each panel into place, coupling it to the building via panel mounting hardware. Components in the conventional panel mounting hardware on the building, on the panel, or in between, can typically be adjusted during installation to shift the position of the panel as needed.

Buildings can also be constructed using pre-fabricated modules that are assembled at remote locations and then delivered to the building job site where they are then lifted and stacked together. The more of the module that is assembled remotely, the less work is required at the building site. Accordingly, it is desirable for the surfaces of modules that will face outwards on the final building to have the facade panels attached before the modules are delivered.

Conventional panel mounting hardware used in non-modular buildings is not well suited for pre-mounting panels to a module. The conventional panel mount hardware design is made with the assumption that panels are first mounted to a building very near to their final position on the building. Such conventional mounting hardware is not configured to handle the very wide range and directions of stresses that can be applied to a panel pre-mounted to a module as the module is swung and lifted in place on a building.

In addition, to limit the total number of interfaces between panels, the panels used in pre-fab building modules are generally much wider and heavier than standard panels and can weigh 1.5 tons or more. Conventional mounting hardware adjustment mechanisms used to tweak panel position during installation typically include slotted parts. When used with a very heavy panel, the friction between the movable parts bearing the weight of the panel can make adjustment difficult or impossible.

An improved facade panel mounting system is needed that addresses these deficiencies. It is further desirable if the panel mounting system will allow a pre-mounted panel to automatically adjust its position as the module is lowered in place so that once the module is fully seated, the panel is properly aligned to a very small tolerance and all that remains to be done on site is to lock the movable components of the panel mounting system in place.

SUMMARY

These and other objects and advantages are provided by a mounting system for building panels which can include a mounting bracket for affixing a building panel to building support structure, such as a prefabricated module, and which bracket allows the position of the panel on the module to be adjusted during panel and module installation at a building side within a relatively wide range of positions. Mullion guides on the sides of the panel automatically adjust a panel position as the panel is lowered in place from a first relatively large horizontal placement tolerance of the module to a smaller horizontal placement tolerance, such as needed for other interacting structures on adjacent sides of installed panels. After the panel is installed, mullion guides on the adjacent panel sides can be removed. The bracket and mullion guides can be used separately or in combination on a prefabricated module with pre-attached panel or in other applications.

According to an embodiment, a mounting system or bracket for attaching a building panel to a building support structure comprises a fixed lower component that can be rigidly connected to a building support structure and a movable upper component that has a panel coupler on it and from which a panel can be hung. A bottom surface of the upper component is spaced apart from an opposing top surface of the lower component and at least part of a bearing assembly, such as a ball bearing, is positioned in the gap between the surfaces. When a panel is mounted, the panel load is transferred, at least in part, from the moving component to the fixed component through the bearing assembly allowing the upper component to move horizontally relative to the lower component with low friction.

A vertical bolt, rod, pin can be fixed to one component and pass through an oversized hole in the other component. For example, a bolt can pass through a hole in the upper component and threadedly engage the lower component. Interaction between the bolt and the periphery of the hole constrain horizontal motion of the upper component relative to the lower component to a predefined amount. The maximum amount of horizontal motion can be selected to be the maximum initial horizontal displacement of the panel relative to its desired position next to an adjacent panel during installation based on expected part and installation tolerances.

In one embodiment, the mounting bracket can be attached to a building support structure and is used to support a panel. The bracket comprises a lower bearing support with a rear portion connectable to a building support, such as by a vertical plate which can be bolted to the building support structure. An upward facing bearing assembly is mounted in the lower bearing support. An upper bearing support with a rear portion is also connected to the vertical support and a downward facing bearing assembly is mounted therein. The downward facing bearing assembly is closer to the vertical support than the upward facing bearing assembly. An anchor plate is positioned between the first bearing support and the second bearing support so that the bottom surface of the anchor plate is in contact with the upward facing bearing assembly and the top surface of the anchor plate is in contact with the downward facing bearing assembly.

A panel coupler is provided to allow the panel to be mounted to and hang from the anchor plate. The anchor plate is supported between the upward facing bearing assembly and the downward facing bearing assembly. The panel load is transferred through the anchor plate and bearing supports to the building support structure. The bearing structures allow the horizontal position of the anchor plate to be easily adjusted even when supporting the full weight of a mounted panel. In an embodiment, two upward facing bearing assemblies are used with a single downward facing bearing positioned laterally between them.

A bolt passing through a large aperture in the anchor plate and engaging a portion of the lower bearing support can be provided to constrain horizontal motion of the anchor plate relative to the lower bearing support to a predefined amount. This amount can be selected to be the maximum initial horizontal displacement of the panel relative to its desired position next to an adjacent panel during installation based on expected part and installation tolerances.

The anchor plate can be locked in a default position, e.g., for transport, by passing a locking bolt through a first locking aperture in the anchor plate and into an aligned locking aperture in the locking block portion of the lower bearing support. The locking pin can be removed before installation. The anchor plate and thereby a panel mounted to the bracket can be locked in position after installation by means of a set screw or bolt engaging a separate second locking aperture and screwed down onto the surface of the lower bearing support.

Another embodiment of the mounting bracket comprises a horizontal support plate configured to be rigidly connected to building support structures at a rear portion of the support plate. A bearing support has a downward facing bearing assembly mounted therein and is positioned above the support plate. The rolling portion of the bearing engages the top surface of the support plate. The front of the bearing support includes a panel coupler from which a panel can be hung. The panel coupler can comprise a vertical track into which a vertical member extending from the panel can be fitted or can be another support structure.

Horizontal flange portions extend laterally from opposite sides of the bearing support and extend over support plate. Each flange has aperture therein. A bolt extends downward the aperture and engages the support plate beneath. The aperture has a diameter substantially greater than the diameter of the bolt. The amount of horizontal motion of the bearing support relative to the support plate is constrained by the interaction of the bolts with the inner peripheries of the apertures. The amount of horizontal motion available can be selected to be the maximum initial horizontal displacement of the panel relative to its desired position next to an adjacent panel during installation based on expected part and installation tolerances.

The head of the bolt is larger than the aperture or the bolt can be fitted a washer larger than the aperture and that is placed over the aperture. The head of the bolt, directly or via the washer, limits the amount the respective flange portion can move upwards away from the support plate and thereby the amount the bearing support can tilt relative to the support plate. The amount of tilt available can be small enough that the flange portions will not contact the support plate at when the bearing support is at maximum tilt. In one configuration, the bolts can be installed so that the washers are loosely held between the top of the respective flanges and the bottom of the bolt heads. This loose connection allows horizontal motion of the bearing support relative to the support plate while allowing only minimal vertical motion.

When a panel is mounted to the panel coupler the load from the panel is transferred from the bearing support through the bearing to the support plate. The bearing support can be locked in a default position, e.g., for transport, relative to the support plate by use of a locking pin. The locking pin can be removed before installation. According to a further embodiment, a prefabricated building module is provided. The building module comprises a chassis and a plurality of mounting brackets, as above attached to a support beam at a top of an outer wall of the module chassis. A panel is mounted to the brackets via the panel coupler. The prefabricated module with attached panel can then be shipped to a building site for subsequent installation in a building. An elastic spacer assembly can be positioned between the panel and the chassis towards the bottom of the panel to limit motion of the panel relative to the module, e.g., when the module with panel is lifted and swung into place at a building site. The spacer assembly can comprise a compression spring, a tension spring, and a distance limiter.

When a pre-fabricated module with an attached panel is lifted for installation its initial horizontal placement relative to a previously placed module and panel may only be accurate to within a tolerance that is much looser than that required for the adjacent sides of the panels themselves. According to a further aspect of the invention a panel alignment system is provided comprising mullion guides mounted to the left and right sides of a panel. The mullion guides on adjacent sides of a placed panel and a panel being lowered interact to adjust the horizontal position of the side of the panel being placed as it is lowered into position.

In an embodiment, a first mullion guide is attached to a first panel side, such as the right side. A second mullion guide is attached to the second panel side, such as the left side of a panel to be installed. In practice a single panel can be provided with both mullion guides installed and where each of the first and second mullion guides on that panel will interact with the opposing second and first mullion guides on adjacent sides of adjacent left and right panels.

The first mullion guide comprises a first alignment structure formed near its top. The first alignment structure defines a first axial channel that extends along at least part of the panel side and widens at its top. The second mullion guide has a second alignment structure formed near its bottom. The second alignment structure defines a second axial channel that that extends along at least part of the panel side and widens at its bottom.

The first alignment structure is configured to capture at least a portion of the bottom end of the second mullion guide in the first axial channel during an installation of the second panel next to the first panel when the bottom end of the second mullion is positioned above the top of the first mullion guide within the designed horizontal tolerance range. As the second panel is lowered, the first alignment structure adjusts the horizontal position of the second mullion guide in one direction, such as front-to-back. At the same time, the second alignment structure is configured to capture at least a portion of the top end of the bottom mullion guide in the second axial channel and adjust the horizontal position of the second mullion guide in a second direction, such as left-to-right.

In an embodiment, the first mullion guide comprises a respective base that is mounted to the first side of the first panel. First and second side walls extend outwards from the base, and a pair of opposing axial flanges extending inwards from the side walls and defining the first axial channel. The second mullion guide comprises a respective base that is mounted to the second side of the panel and an axial wall extending away from the base. The axial wall extends along at least part of the panel side. One or more guide blocks are mounted to one side of the axial wall near its bottom defining the second axial channel.

In operation, as the panel is lowered, the first axial channel will capture the axial wall on the second mullion guide and funnel the leading edge of axial wall into the main part of the first axial channel, moving the second mullion guide it front-to-back as needed. Generally (although not necessary) at the same time the second axial channel will capture one of the flanges at the top of the first mullion guide and the interaction of the captured flange with the boundary of the second channel moves the second mullion left-to-right as needed. Another 'second axial channel' can be formed on the other side of the axial wall so that both flanges of the first mullion guide are captured.

In an embodiment, the first mullion guide can extend above the top of the panel and the alignment structures on the first and second mullion guides positioned so that as a panel is lowered in place, the alignment structures operate to align the side wall of the panel being lowered before other structures on the adjacent sides of the panels that require a tight placement tolerance start to interact.

According to a further embodiment, the mullion guides can be slidably and removably mounted in tracks attached to the sides of the panels. The bottom position of each mullion guide in the track can be fixed by a stop in the track, such as a set screw. The top of each mullion can be temporarily attached to the respective panel with a locking screw. After the panel is installed, the locking screws can be removed and the mullion guides lifted out from between the adjacent sides of the panel.

In addition to mullion guides, the panel can further have an alignment pin extending upwards from the top of the panel and an alignment aperture in the bottom of the panel. The alignment pin and aperture help align the free side of a panel being installed (e.g., the side not aligned by the interacting mullion guides) with a panel underneath.

DESCRIPTION OF THE DRAWINGS

Various features and advantages of the invention, as well as structure and operation of various aspects of the methods and systems of the invention embodiments are disclosed in detail below with references to the accompanying drawings, in which.

DETAILED DESCRIPTION

Figure 1A:
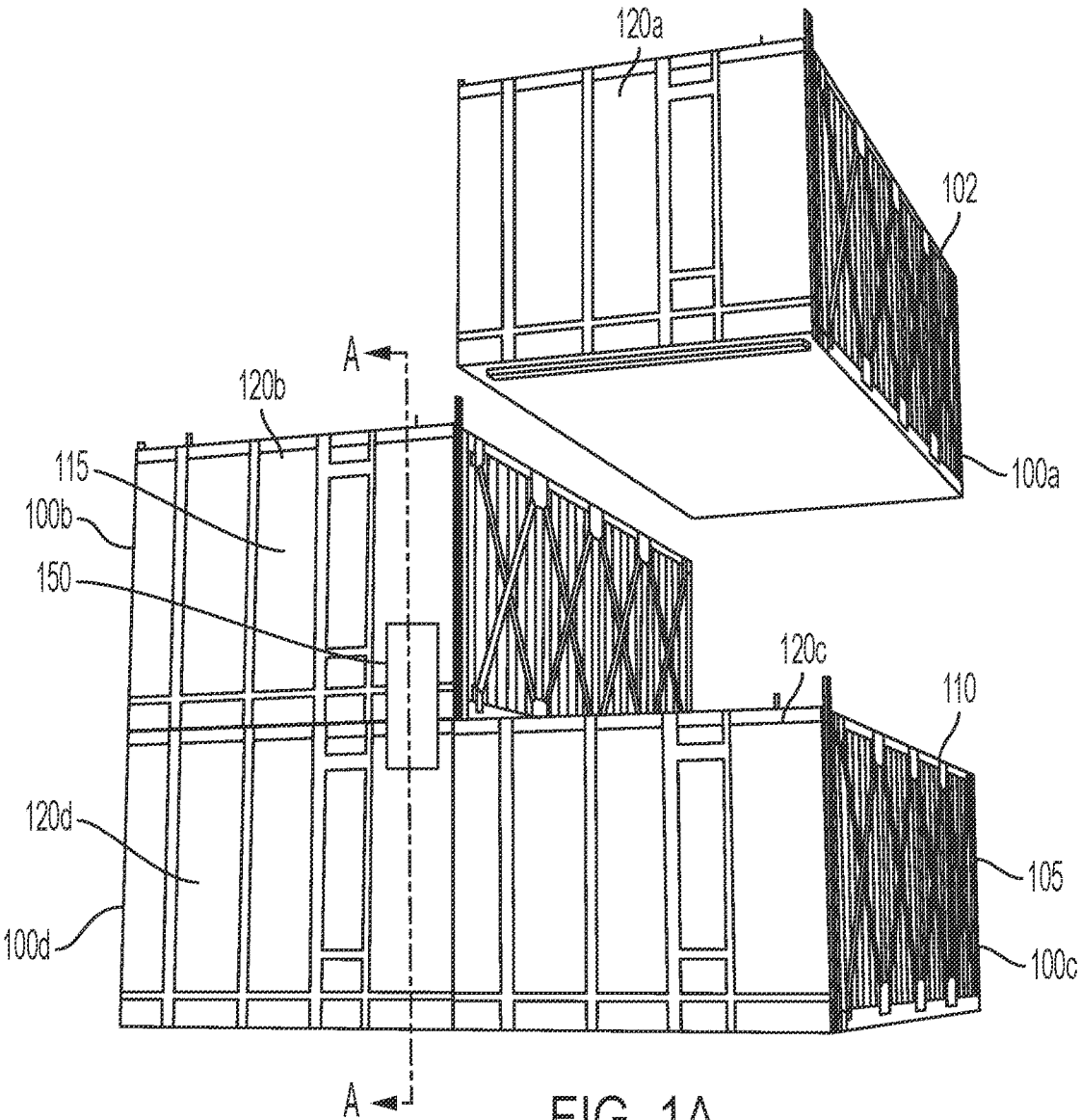
FIG. 1A is an illustration of several prefab building modules being combined to form a building structure.

FIG. 1A is an illustration of several prefab building modules 100 being combined to form a building structure. A module 100 is built around a structural chassis 102 comprising vertical and horizontal supports 105, 110. The modules 100 have an outer face 115 which will be facing outwards from a building once the module is put in place. One or more facade panels 120 are mounted to the module outer face 115. FIG. 1 shows facade panels 120*a*, 120*b*, 120*c*, and 120*d* mounted to respective modules 100*a*, 100*b*, 100*c*, 100*d*, where the panels can be mounted to a module before the module is placed at the building site. While panels are preferably installed prior to delivery of the module to a building site, it is possible for panels 120 to be attached to modules 100 after delivery to a site but prior to placement or attached after modules 100 are positioned in place within a building structure, in a manner similar to placement of panels on the structure of high-rise buildings made using conventional building techniques without pre-fab modules.

Figure 1B:
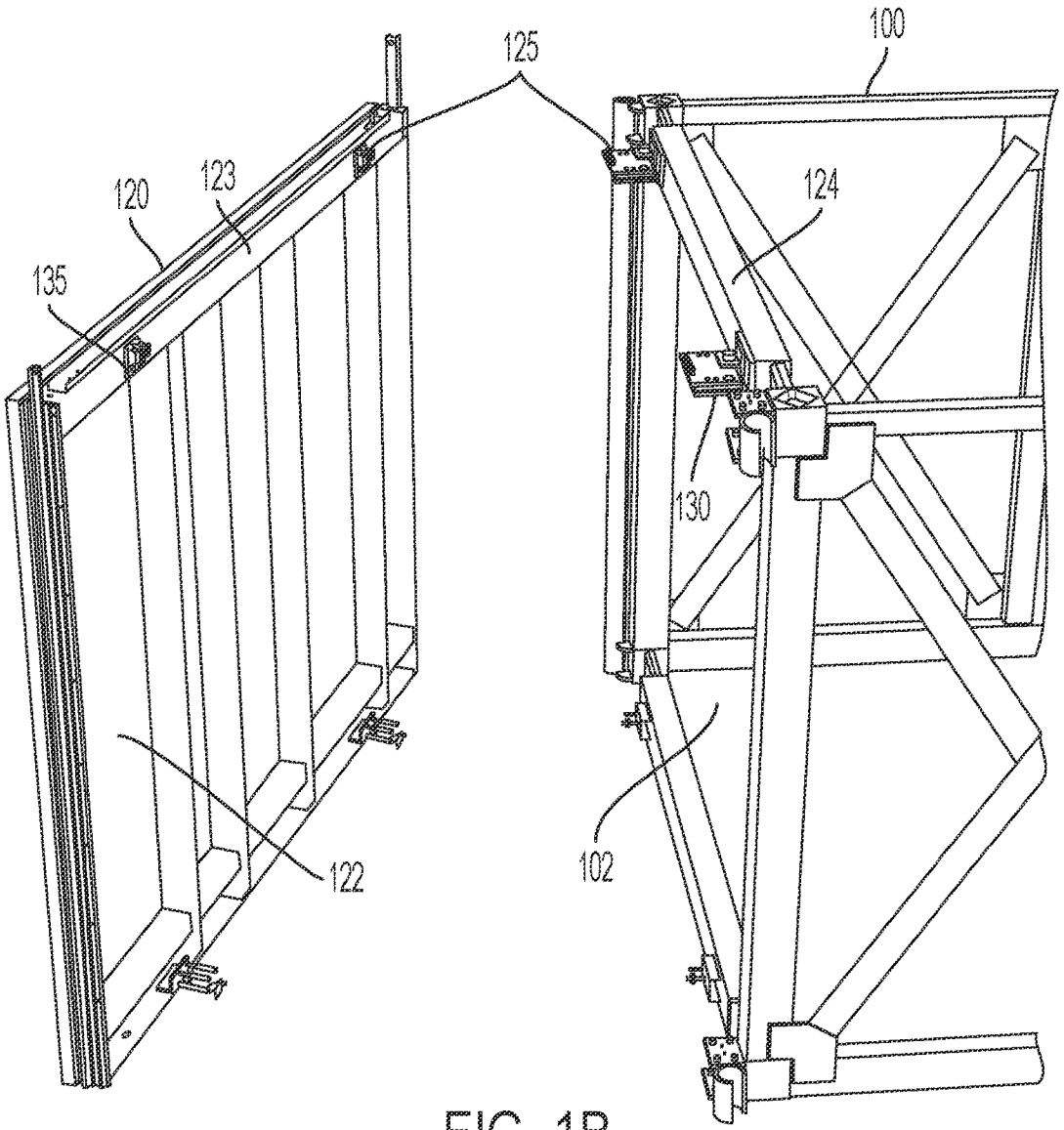
FIG. 1B is an illustration of a rear face of a panel and the outer face of a module.

FIG. 1B is an illustration showing a rear 122 of a panel 120 and an outer face or side of chassis 102 of a module 100. A panel mounting system 125 comprises an adjustable bracket assembly 130 with a panel coupler. A corresponding panel mating component adjustably mounted to the panel, such as hook assembly 135, can engage the panel coupler to connect a portion of a panel 120, such as top transom portion 123, to a load bearing building structure such as a top horizontal beam 124 of a module 100. The bracket assembly 130 is mounted to outward facing building support structure and the hook assembly 135 is mounted to the rear surface of a panel frame 120, such as rear surface of top portion 123. While the bracket assembly 130 is illustrated as being mounted to the top horizontal beam 124 of a module 100, bracket assembly 130 can be mounted in any desired position along a building support. Likewise, while panel mating components, such as the hook assemblies 135, are illustrated as being mounted to the top transom 123, they can be mounted in any desired inward facing position of the panel wall, preferably towards the top of the panel. The bracket assemblies and panel mating components are provided in pairs and positioned so that the paired components 130, 135 engage when a panel 120 is mounted to a module 100.

As discussed in more detail below with respect to FIGS. 2A-2D and FIGS. 9A-9D, the bracket assembly used to attach a building panel to a building support structure comprises a fixed lower component that can be rigidly connected to a building support structure, such as by welding, bolting, or other manner, and a movable upper component from which the panel can be hung via a mating component that engages a panel coupler on the movable upper component. The upper component has a bottom surface that is above and spaced apart from a top surface of the lower component. A bearing assembly has a rolling bearing portion that extends into the gap between the spaced apart surfaces. In an embodiment, the rolling bearing portion is a spherical ball bearing although linear (cylindrical) bearings may be used in some configurations.

When a panel is mounted to the bracket, load from the panel is transferred from the moving component to the fixed component through the bearing assembly. Use of the bearing allows the upper component to move horizontally relative to the lower component with low friction. As a result, the position of the panel can be easily adjusted during installation, e.g., of a pre-fab module with paneling pre-attached so that the panel can be properly aligned and mated with an adjacent panel on an already placed module.

To constrain the range of horizontal motion of the upper component, a vertical bolt, rod, pin, or other member can be fixed to one component and pass through an oversized hole in the other component. For example, a bolt can be engaged in the lower component and extend vertically through a hole in the upper component having a diameter substantially larger than the diameter of the bolt. Interaction between the bolt and the periphery of the hole constrains the range of horizontal motion of the upper component relative to the lower component to a predefined amount. The maximum amount of horizontal motion can be selected to be the maximum expected horizontal displacement of the panel relative to its desired position next to an adjacent panel during installation based on expected part and installation tolerances.

A separate locking pin or screw can be used to temporarily prevent the upper component from moving relative to the lower component. This is useful to prevent panels that are pre-installed on a building module from shifting position as the module is transported to the building site. Before installation of the module, the locking pin can be removed so the panel position can be adjusted.

Figure 2A:
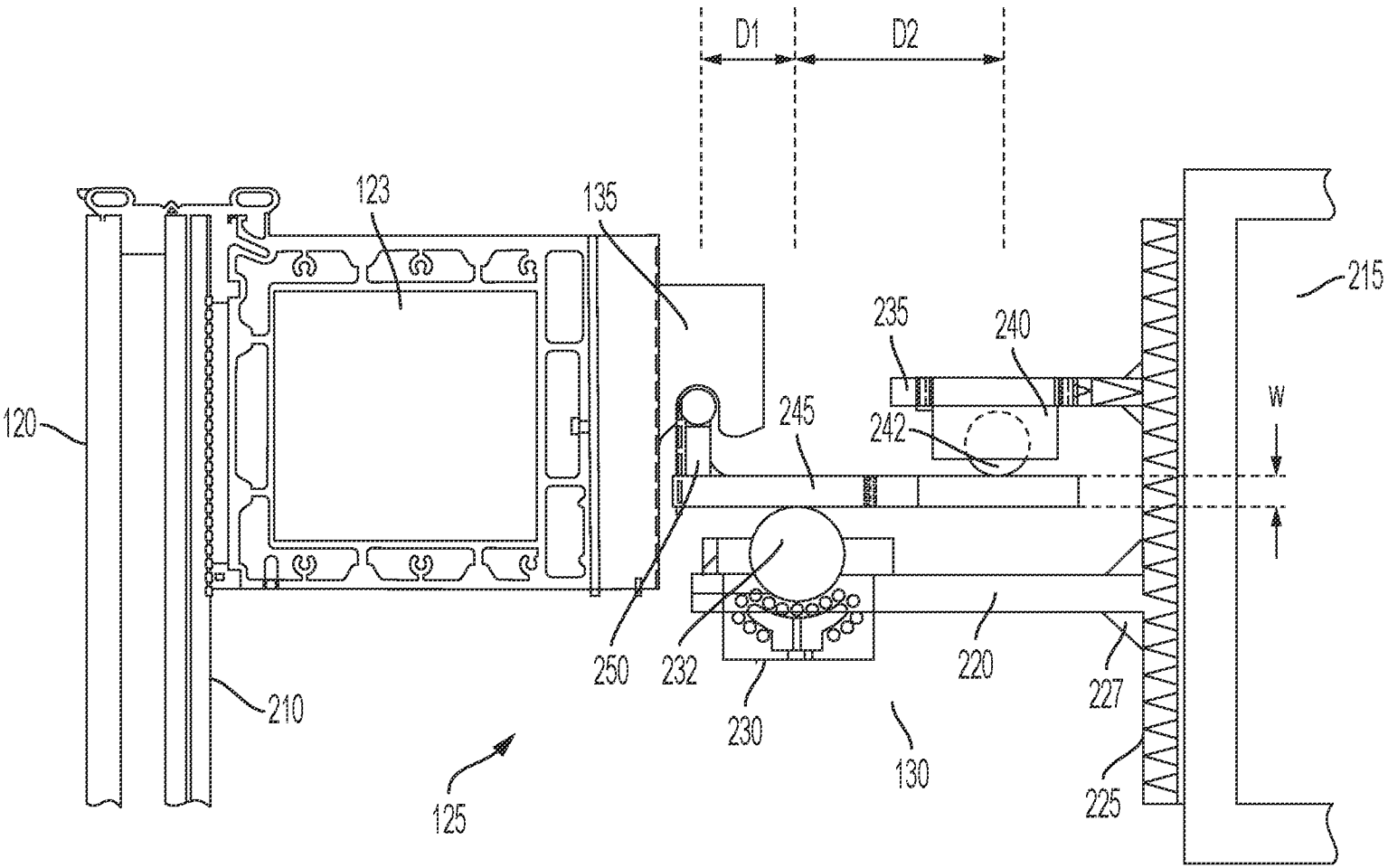
FIG. 2A is a cross-section view of a panel mounting system according to an embodiment.
Figure 2B:
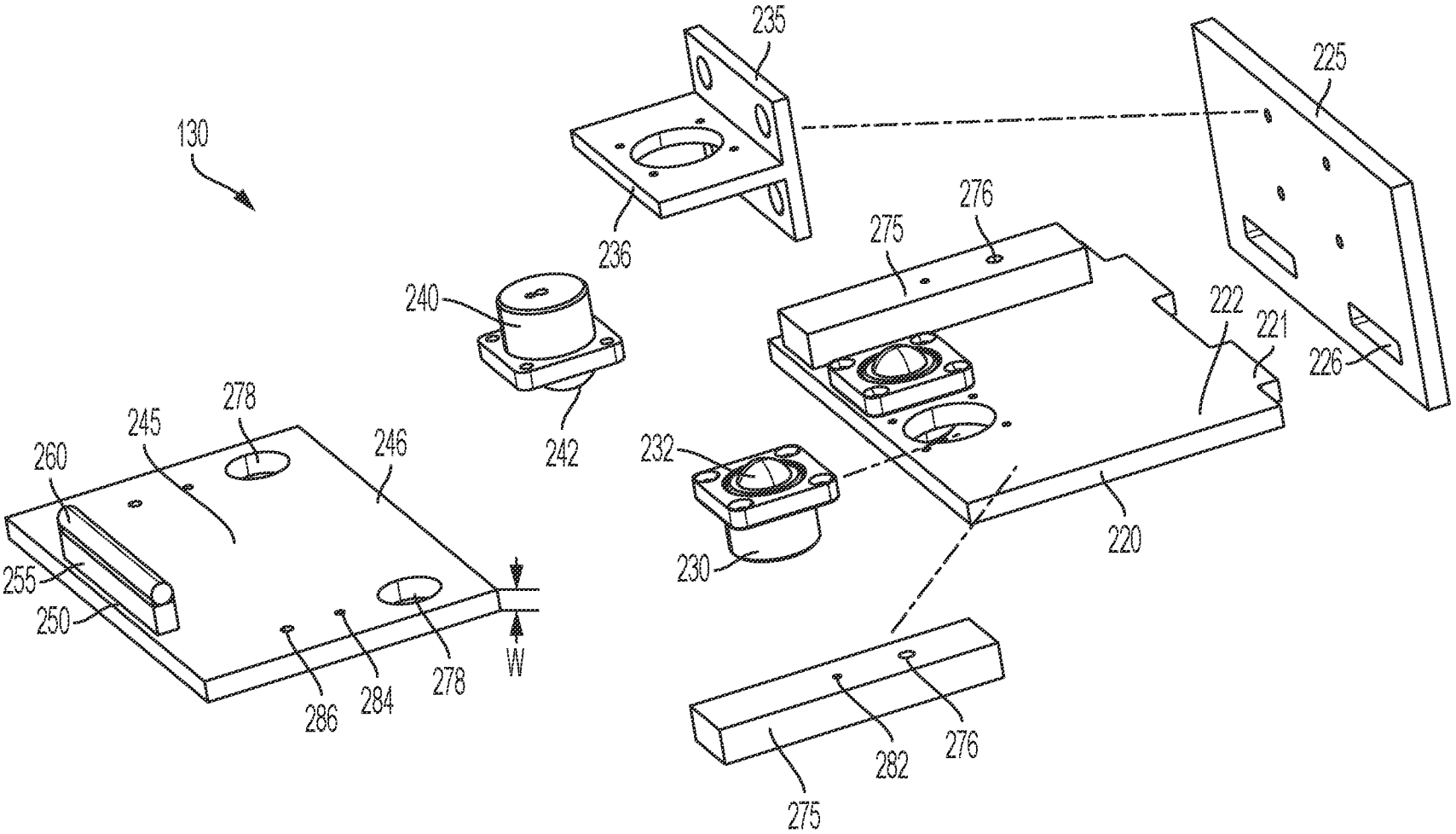
FIG. 2B is an exploded view of the bracket assembly of FIG. 2A.
Figure 2C:
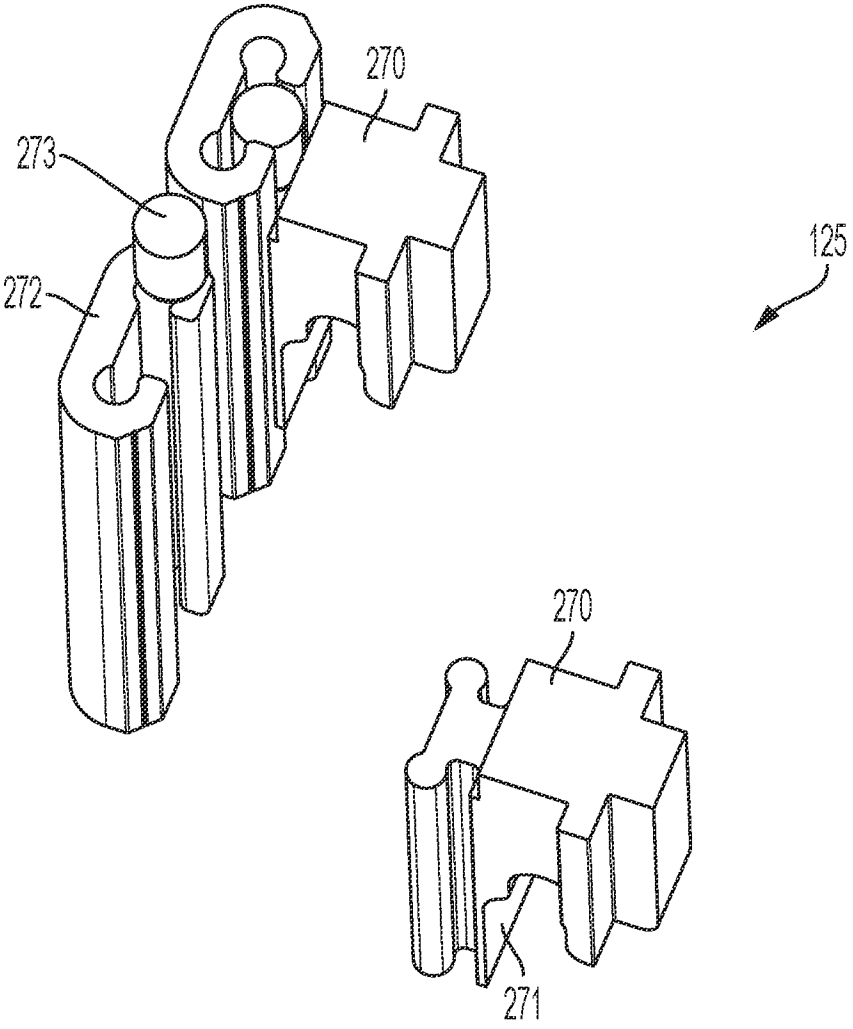
FIG. 2C is a partial exploded view of the hook assembly of FIG. 2A.
Figure 2D:
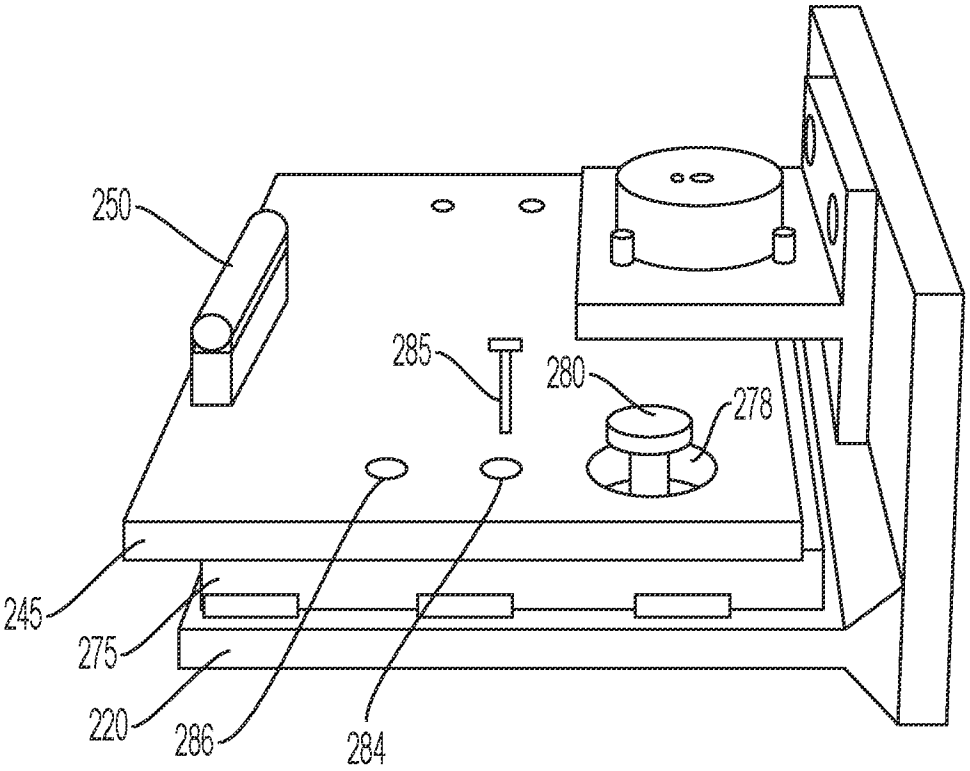
FIG. 2D is a perspective view of the bracket assembly of FIG. 2A.

Turning to the embodiment of FIGS. 2A-2D, FIG. 2A shows a cross-section of area 150 in FIG. 1A along line A-A illustrating a panel mounting system 125 connecting panel 120, through a panel transom 123, to a horizontal support element 215 on a module 100, such as a hollow tube or wide flange support beam along the top of the module 100. FIG. 2D is a perspective view of the bracket assembly in FIG. 2A. FIG. 2B is an exploded perspective view of the components of the bracket assembly 130. FIG. 2C is an exploded perspective view of the components of the hook assembly 135.

With reference to FIGS. 2A and 2B, bracket assembly 130 comprises a vertical support 225 such as a vertical plate that can be mounted to the building support member 215, such as by bolting or welding it in place. A lower bearing support 220 extends outwards from the vertical support 225. One or more upward facing bearing assemblies 230 are mounted in the lower bearing support 220 so that bearing 232 in each bearing assembly 230 projects over the top surface 222 of the lower bearing support 220 adjacent the bearing assembly 230. An upper bearing support 235 extends outwards from the vertical support 225 above the lower bearing support 220. One or more downward facing bearing assemblies 240 are mounted in the lower bearing support 220 so that the bearing 242 in each bearing assembly 240 projects below the lower surface 236 of the upper bearing support 235 adjacent the bearing assembly 240.

There a variety of ways in which the lower bearing support 220 and upper bearing supports 235 can be connected to the vertical support 225. One or both of these components can be integrally formed with the vertical support 225, such as by casting and/or machining. Alternatively, one or both of the upper and lower bearing supports 220, 235 can be formed separately and then secured to the vertical support 225 using various means known to those of skill in the art. For example, a portion of a support plate can engage an aperture in the vertical plate, such as rearward tabs 221 on lower bearing support 220 that engage apertures 226. The parts can then be welded in place. Fillet welds 227, as shown in FIG. 2A, and additional supports can be used above and below a bearing support to provide further rigidity and strength to the connection. Alternatively, a support plate can be formed in a T shape and bolted to the vertical support 225, such as shown in FIG. 2B for upper bearing support 235. While the vertical support 225 is shown as a plate that can be connected to a horizontal support structure, e.g., in a module 100 or other building structure, the vertical support 225 could alternatively be a section of the horizontal building support itself so that the upper and lower bearing supports 220, 235 are directly connected to the relevant horizontal support instead of being connected to an intermediate component that itself is connected to the horizontal support.

An anchor plate 245 is provided with a panel coupler to which a mating component attached to the panel can couple to thereby attach the panel to the anchor plate. As shown in this embodiment, the panel coupler comprises a panel hook support portion 250 near the front end of the anchor plate 245 and on which the hook assembly 135 can hang. Other panel coupler and mating components can be used. An alternative arrangement is discussed further below with respect to FIGS. 9A-9F. In the illustrated embodiment, support portion 250 comprises a wall 255 extending vertically upwards from the anchor plate 245 and that has a curved top edge 260 that can be shaped to substantially match the shape of at least part of the hook assembly throat 271 which will rest on it. In an alternative embodiment, instead of an upward wall 255, anchor plate 245 can be formed with a lateral slot or groove along its front end that can receive the end of the hook and the throat of the hook will engage the forward end of the anchor plate itself.

Any suitable hook assembly 135 can be used on the panel 120 to couple it to the bracket assembly 130. One example of a hook assembly 135 is shown in FIG. 2C and comprises one or more hooks 270 each having a throat 271 and that is slidably engaged with a knuckle 272 that can be mounted to the rear surface 140 of the panel frame. The vertical position of the hook 270 can be adjusted by a screw mechanism 273. One or more set screws can be used to lock the hook 270 in place within knuckle 272. Two or more hook assemblies 135 can be positioned adjacent each other to engage the same support portion 250.

Returning to FIGS. 2A and 2B, anchor plate 245 is fitted between the lower and upper bearings 232, 242. In an embodiment, at least a rear portion 246 of anchor plate 245 is substantially planar with a thickness W between top and bottom surfaces of rear portion 246. The vertical distance between the top of the lower bearing(s) 232 and the bottom of the upper bearing(s) 242 is approximately W so that the anchor plate 245 can sit substantially horizontally between the lower and upper bearings 232, 242. The particular thickness W is dependent on various factors, including the overall weight the mounting assembly 125 is engineered to support.

When a panel is hung from the support portion 250, the anchor plate 245 acts as a lever arm to transfer the weight of panel to the vertical support 225 with the point of contact between the anchor plate 245 and the lower bearing(s) 232 acting as a fulcrum. The upper bearing(s) 242 keeps the back end of the anchor plate 245 from rotating away from the module structure. Advantageously, since all of the panel weight applied to the support portion 250 is transferred through the bearing system, the position of the anchor plate 245 in the X/Y plane can be easily adjusted and without suffering from the friction limitations present in conventional panel mounting and support brackets even when the mounting system 125 is fully loaded.

As shown in FIG. 2A, the distance D1 between the fulcrum and the support portion 250 can be less than the distance D2 between the fulcrum and the point of contact of the anchor plate 245 with the upper bearing(s) 242 so that most of the panel weight is transferred through the fulcrum and the lower bearing support 220. For example, in the embodiment shown in FIG. 2A, D2 is about 1.5×D1. As a result, the upper bearing support 245 and upper bearing assembly 240 do not need to be as robustly engineered (thus decreasing weight and expense) as the lower bearing support 220 and lower bearing assembly 230

The bearing assemblies 230, 240 should be appropriately heavy duty bearing assemblies each configured to support at least the maximum expected static load from the panel with appropriate safety factors added in. The anticipated static load on each bearing assembly can be calculated based on the maximum weight of the panel 120, the geometry of the anchor plate 245, and the number of lower and upper bearing assemblies used.

In a particular embodiment, the system is designed to support a panel having a maximum weight of about 1.5 tons and has two lower bearing assemblies 230 positioned in the lower bearing support 220 and one upper bearing assembly 240 in the upper bearing support 235 providing three points of contact to stabilize the anchor plate 245. A suitable bearing assemblies for this particular configuration is an Omnitrak™ 9341 heavy duty ball transfer unit.

Because of the large amount of force applied at the point of contact between the bearings 232, 242 and a loaded anchor plate 245, some engraving of the anchor plate surface may occur if the anchor plate 245 is made with conventional (soft) structural steel. Such engravings could make it more difficult to adjust the position of the loaded anchor plate 245. To address this, anchor plate 245 can be made of tempered steel or include tempered steel inserts, such as pucks or disks, added in the areas around the bearing points of contact (not shown).

Bearing assemblies 230, 240 in the illustrated embodiment have spherical bearings to support the anchor plate 245 thereby allowing the anchor plate 245 to move along both horizontal axes. In an alternative embodiment where adjustment of the anchor plate 245 along only a single axis is needed, the bearings 232, 242 could be cylindrical to allow movement of the anchor plate in a direction perpendicular to the axis of the cylindrical bearing.

During production of a prefabricated building module, the bracket assembly 130 can be attached to the chassis and a panel with corresponding hook assembly 135 hung therefrom prior to delivery of the module 100 to a building site. The anchor plate 245 can be positioned in an initial position on the bracket, locked in place for transport, and then unlocked for installation When unlocked the anchor plate can be moved freely horizontally a relatively large amount relative to the final placement tolerance of the panel, such as between 8-10 mm. This allows the panel position to be adjusted so as to absorb the larger installation tolerances of initial placement of the module 100 before it is fully lowered into place. As discussed in more detail below, an additional mullion guide system can be provided on left and right panel sides to automatically adjust the position of a panel being lowered relative to an already placed panel to achieve second smaller placement tolerance, such between 1-3 mm, that may be required by other interacting structures on adjacent sides of the panel. Advantageously, and particularly when used in conjunction with a panel guide system that positions the panel as the module 100 is placed, the anchor plate 245 will automatically adjust as the module 100 and attached panel 120 is lowered into position and the mullion system provides for further adjustment. After final placement of the panel on site, a worker can easily fix the anchor plate 245 in position on the bracket to thereby lock the panel's position.

Turning to FIGS. 2B and 2D, one or more locking blocks 275 are mounted on the top surface of 222 of the lower bearing support 220. For example, two locking blocks 275 can be provided and mounted on the left and right sides of the lower bearing support 220 with the upward facing bearing assemblies 230 in between. The locking blocks 275 are configured so that they have only minimal effect, if any, with the movement of the anchor plate 245 between the bearings 232, 242. With a generally planar anchor plate 245, the top surface of the locking block 275 should have a height above the top surface 222 of the lower bearing support 220 that is lower than the height of the bearing 232 above the anchor plate so that the anchor plate 245 is supported by the bearings and rides at least slightly above the locking blocks 275. Locking block 275 can be formed separately from the lower bearing support 220 and attached thereto using conventional means, such as bolts and/or welding. Alternatively, locking block 275 could be integrally formed with the lower bearing support 220.

Locking blocks 275 each have a respective first aperture 276 that is configured to receive the shaft of a bolt 280. Corresponding adjustment apertures 278 are provided in the anchor plate 245 and positioned so that when the anchor plate 45 is placed over the lower support 220, the first apertures 276 are accessible through the adjustment aperture 278. The diameter of the adjustment aperture 278 is selected so that when bolt 280 is mounted in the first aperture 276 the anchor plate 245 has a maximum horizontal range of motion of at least the desired adjustment amount.

To initially secure the anchor plate 245 in position for transport a locking bolt (threaded or unthreaded) or similar component 285 can be passed through aperture 284 in the locking plate 245 and into corresponding aperture 282 in the locking block. Prior to installation of the module 100 with mounted panel 120 the locking bolt is 285 is removed so the anchor plate 245 can be adjusted.

Once the panel is properly positioned and aligned on a building, a locking set screw 289 (which can be the same or different from the locking bolt 285) is screwed into threaded aperture 286 in the anchor plate so that its leading end engages the top surface of the locking block 275 beneath the aperture 286. When screwed in tightly, friction between the leading end of bolt 289 and the locking block 275 will inhibit motion of the locking plate 245 relative to the support plate 220. Preferably the aperture 286 is positioned and locking block 275 configured so that the aperture 286 will be above the locking block 275 throughout the entire adjustment range of the locking plate 245. Aperture 286 is also preferably displaced from aperture 285 an amount greater than the adjustment range of the locking plate 245 to avoid the possibility of aperture 276 in the locking block 275 being exposed through aperture 286 in the locking plate 245, which situation may interfere with the ability of the locking plate 245 to be securely locked in an adjusted position.

Figure 9A:
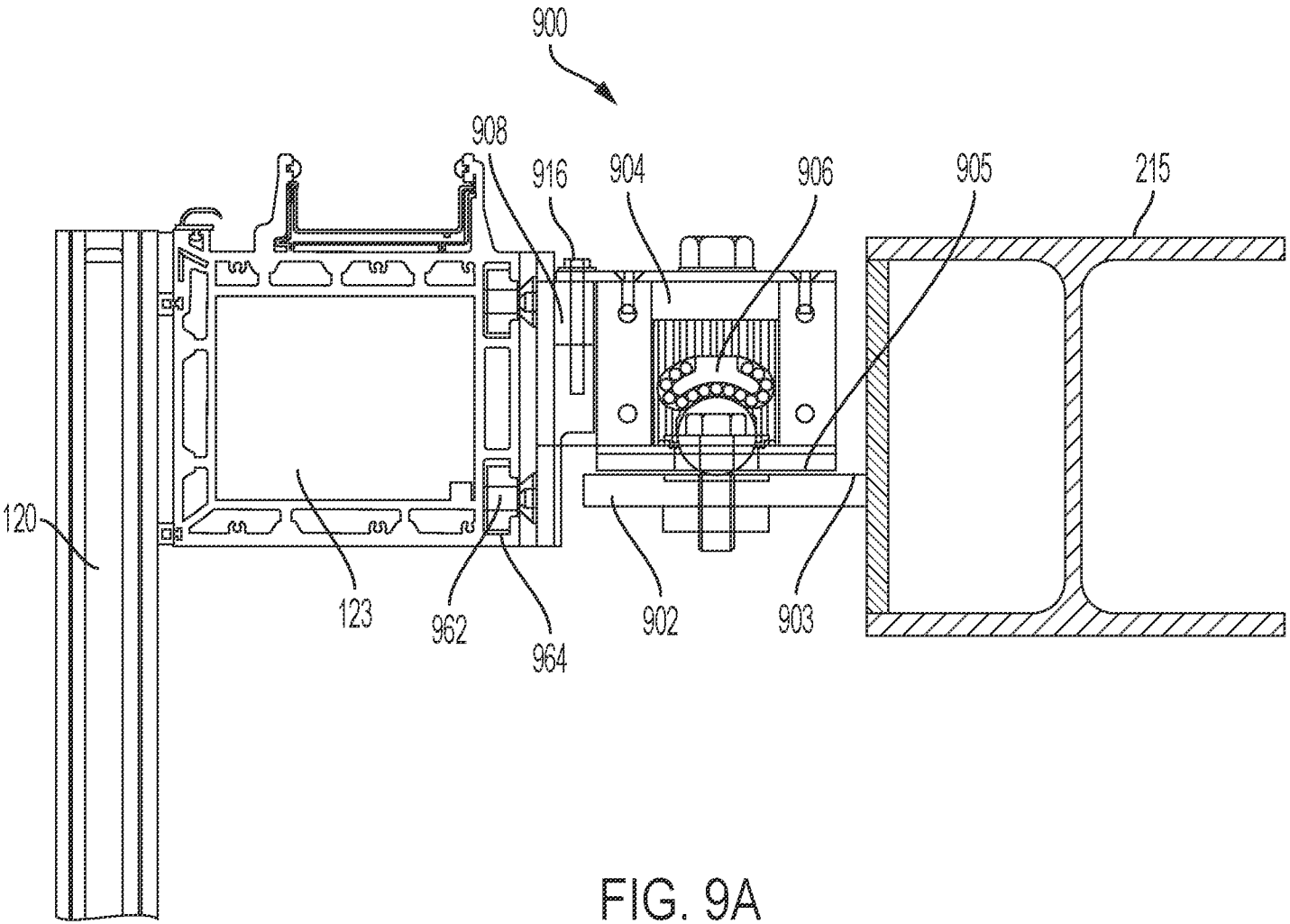
FIG. 9A is a cross-section view of a panel mounting system according to a further embodiment.
Figure 9B:
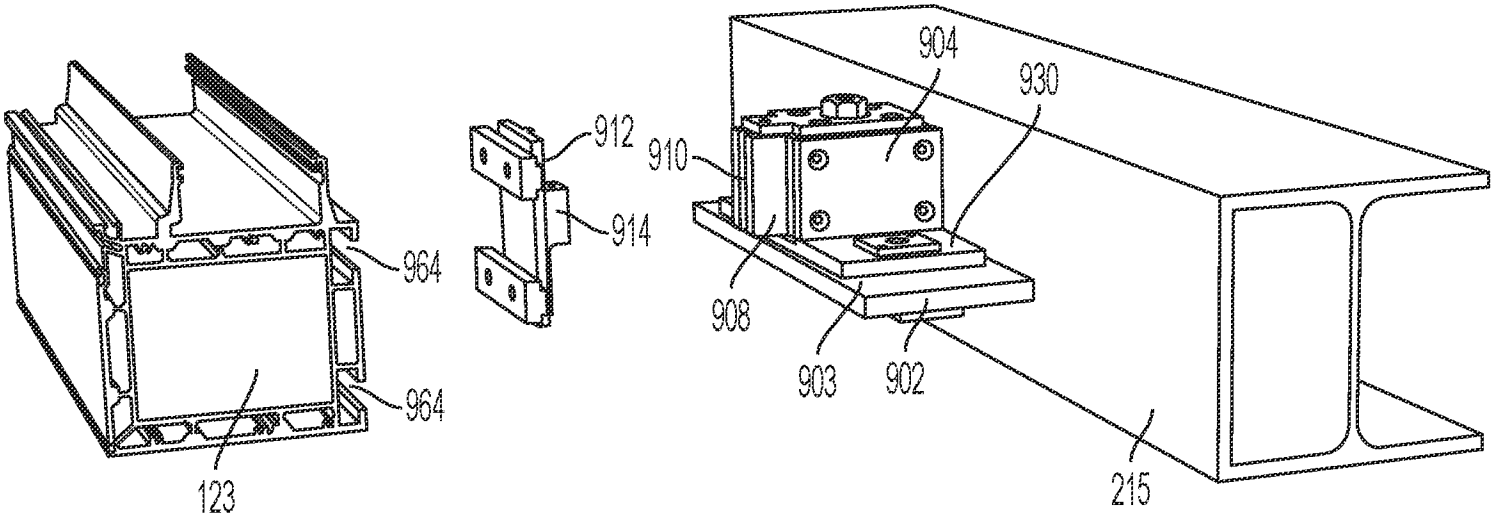
FIG. 9B is a partial exploded view of the bracket assembly of FIG. 9A.

Turning to FIGS. 9A-9F there is shown another embodiment of a bracket assembly 900 that can be used in a panel mounting system as discussed herein. FIG. 9A is a cross-section view of panel mounting system with the bracket assembly 900. FIG. 9B is a partial exploded view of the bracket assembly of FIG. 9A. This embodiment can be used in the same general manner as discussed above generally and with reference to the embodiment of FIGS. 2A-2D and designed to meet the same general specifications.

With reference to FIGS. 9A and 9B, bracket assembly 900 comprises a horizontal support plate 902 that is configured to be rigidly connected to building support structures 215 at a rear portion of the support plate 902. A variety of means known to those of skill in the art can be used to connect the horizontal support plate 902 to a building support structure 215, such as those discussed above with respect to bracket assembly 130 and connection of the lower support plate 220 to vertical support 225.

A bearing support 904 has a downward facing bearing assembly 906 mounted in it. A portion of the rolling bearing 907 in bearing assembly 906 (See FIG. 9C) extends downward past lower surface 905 of the bearing support 904. The bearing support 904 is mounted over the support plate 902 so that the rolling bearing engages the top surface 903 of the support plate. The front of the bearing support 904 has an outward facing panel coupler 908 from which a panel can be hung. As noted, any suitable panel coupler can be used.

Figure 9C:
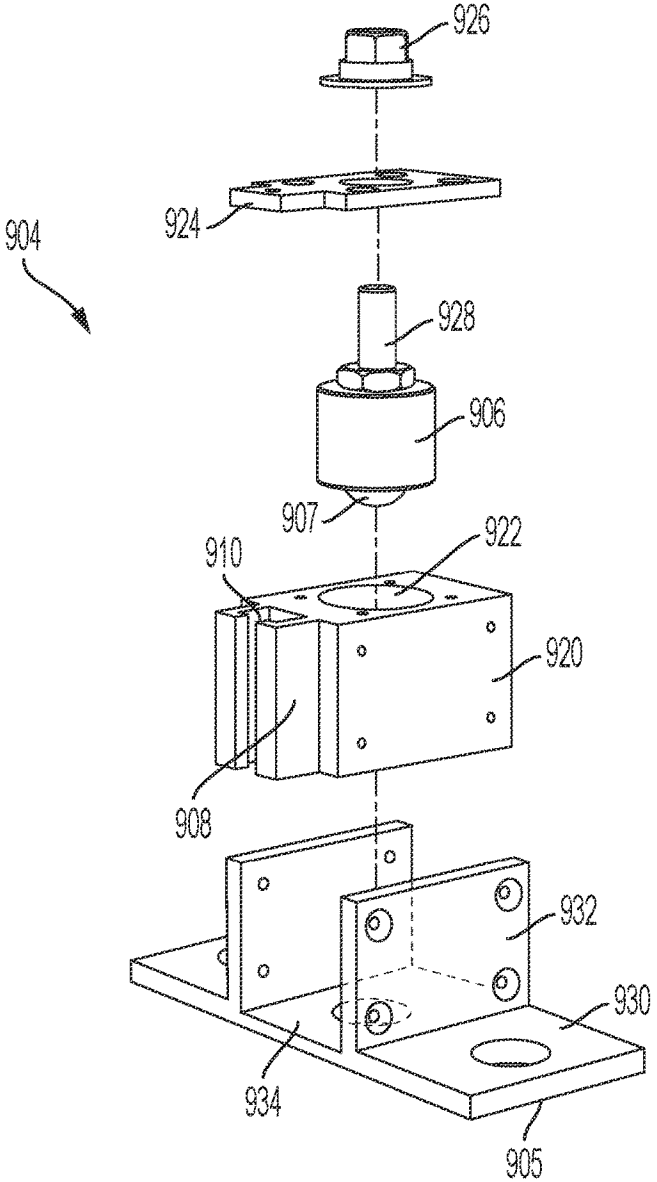
FIG. 9C is an exploded view of the bearing support of FIG. 9A.

FIG. 9C is an exploded view of the bearing support 904. In the illustrated embodiment, a main body 920 has a vertical aperture 922. Bearing assembly 906 is mounted to a cap 924, such as with bolt 926 that engages a rod 928 of the bearing assembly. Bearing assembly 906 is fitted into aperture 922 and the cap 924 is affixed to the main body 920, such as with screws. Alternative ways of mounting the bearing support 904 to the main body 920 known to those of skill in the art can also be used.

A pair of horizontal flange portions 930 extend outwards from the bottom of the bearing support. In the illustrated embodiment, the main body 920 is fitted between and attached to vertical members 932 extending upwards from a base plate 934. The bottom of the base plate 934 forms the lower surface 905. The base plate extends horizontally from the vertical members 932 to form flange portions 930. Base plate 934 has a central aperture 936 through which through which portion of the rolling bearing 907 in bearing assembly 906 extends. While main body 920 and the base plate 934 that forms the flanges 930 are shown as separate components, flanges 934 can be integrally formed with body 920 or connected in other manners.

Figure 9D:
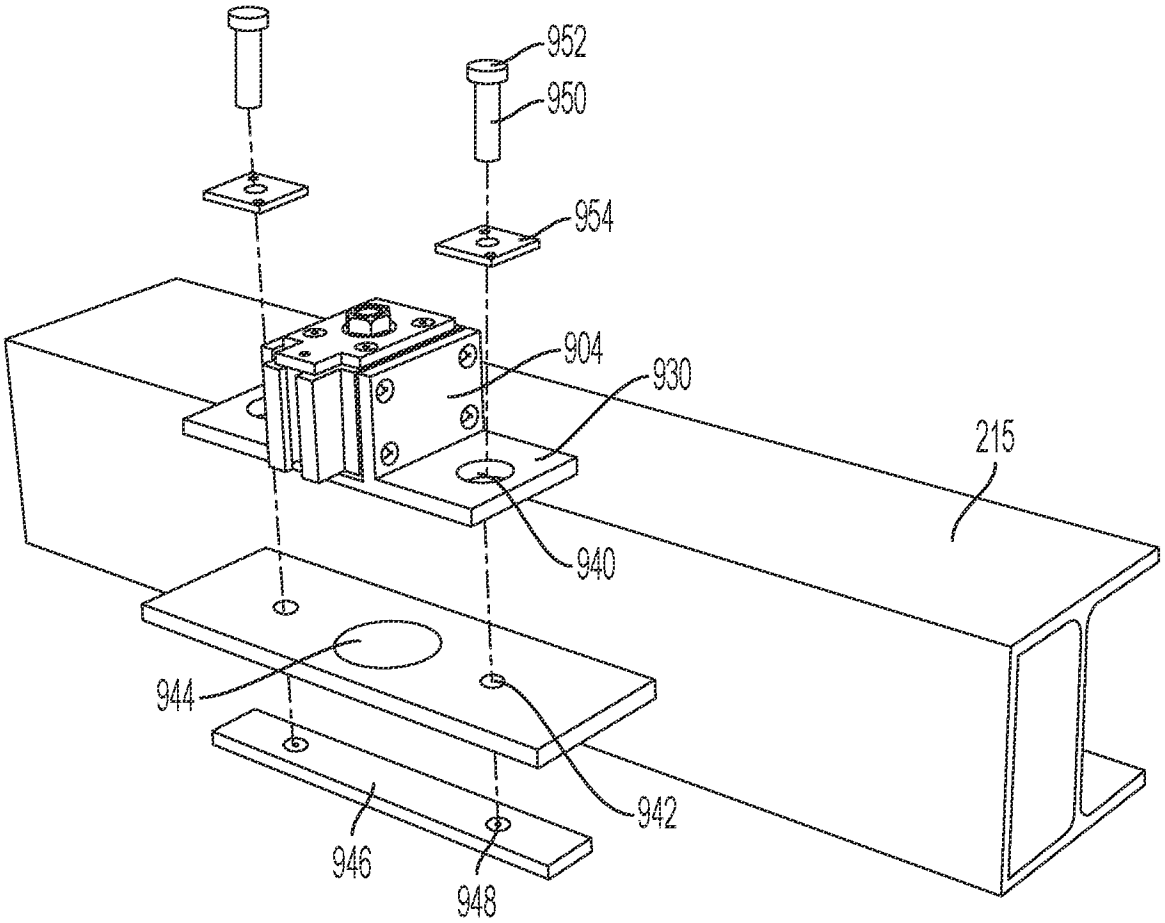
FIG. 9D is an exploded view of the connection between the bearing support and the support plate of the bracket assembly of FIG. 9A.
Figure 9E:
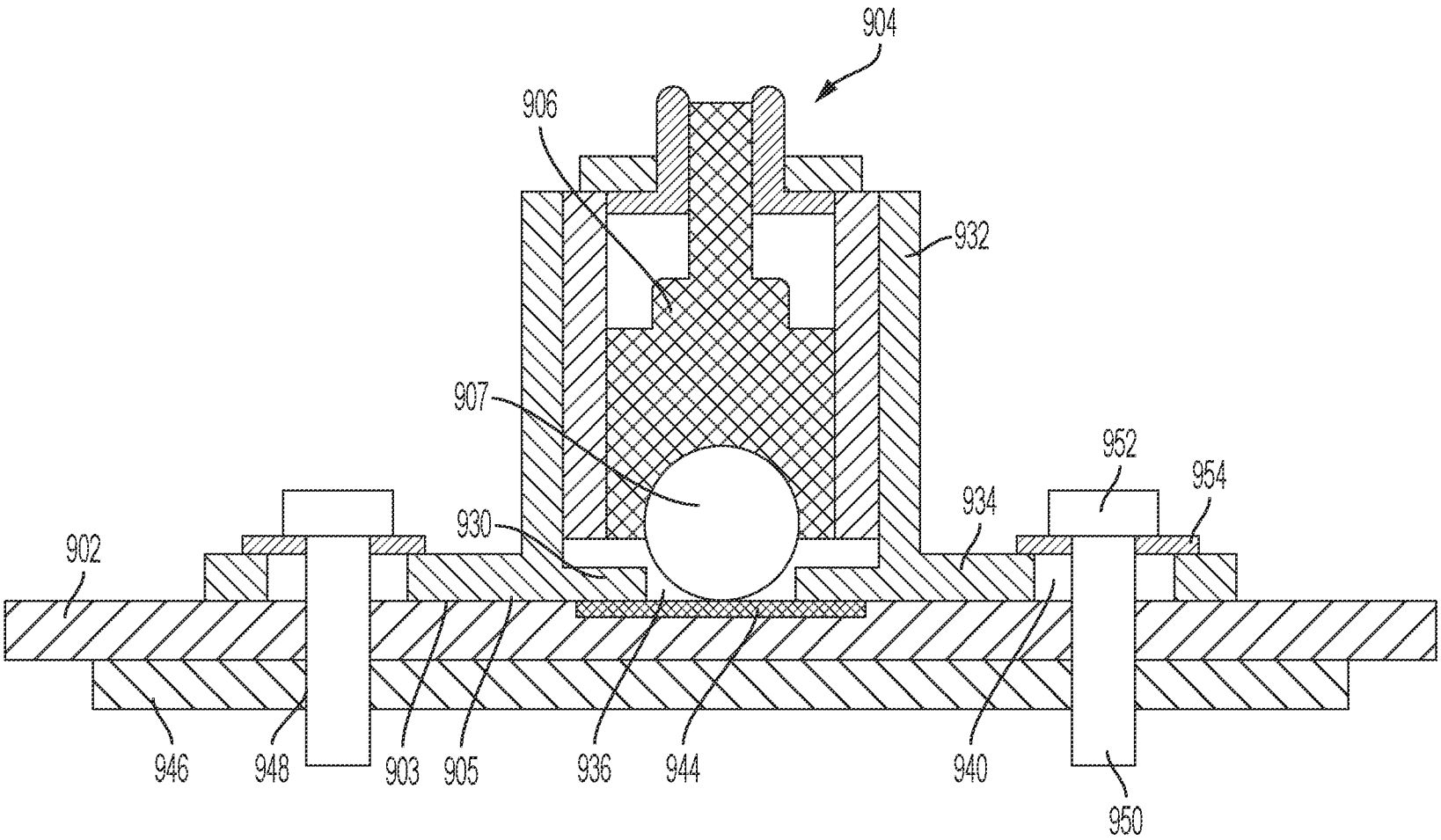
FIG. 9E is a transverse cross-section of the bracket assembly of FIG. 9A.
Figure 9F:
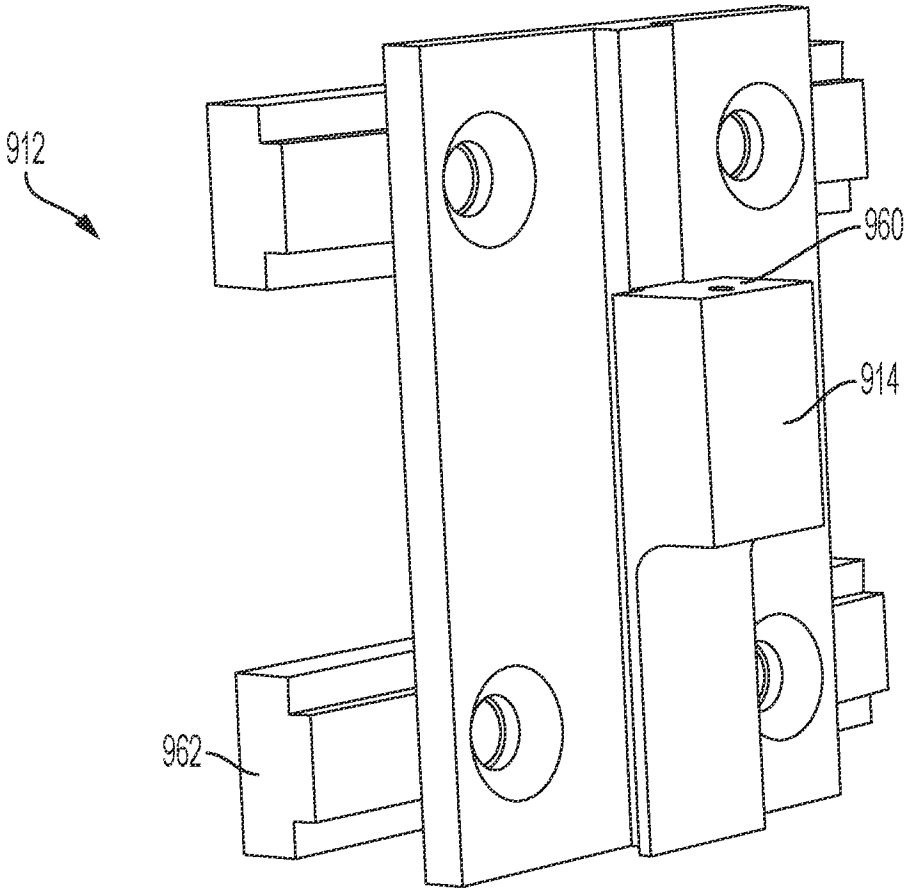
FIG. 9F is a detail view of the panel mounting member that engages the panel coupler in the bracket assembly of FIG. 9A.

FIGS. 9D and 9E illustrate the mounting of bearing assembly 904 to the support plate 902. Bearing assembly 904 is positioned over the support plate 902 with the roller bearing 907 in contact with the upper surface 903 of the support plate 902 and with the lower surface 905 of the bearing assembly 904 spaced apart from the upper surface 903 of the support plate 902. Because of the large amount of force applied at the point of contact between roller bearing 907 and the upper surface 903 when a panel is mounted to the bearing assembly, some engraving of the support plate 902 may occur if it is made with conventional (soft) structural steel. Such engravings could make it more difficult to adjust the position of the loaded bearing assembly 904. To address this, the support plate 902 can be made of tempered steel or include tempered steel insert 944 in the areas around the bearing point of contact.

Each of the flanges 930 has an aperture 940 formed therein. The bearing assembly 904 is positioned so apertures 940 are aligned with apertures 942 formed in the support plate 902. For each flange 930, a bolt 950 is passed through the respective aperture 940 and into the respective aperture 942 in the support plate. The bolt 950 can be affixed to the support plate at aperture 942. A lower plate 946 can be provided beneath the support plate 902 and the bolts pass through apertures 942 and engage respective apertures 948 in the lower plate 946. In an embodiment, the bolts 950 threadedly engage the apertures 948 in the lower plate 946 and may also threadedly engage the apertures 942 in the support plate 902.

The horizontal range of motion of the bearing assembly 904 relative to support plate 902 is constrained by the by the bolts 950 interacting with the inner periphery of the apertures 940. As discussed above, the relative dimensions of the bolts and apertures can be selected to restrict horizontal motion to a desired maximum offset, such as an offset commensurate with the panel placement tolerance.

The heads 952 of the bolt have a diameter greater than the diameter of aperture 940 or a washer with a diameter greater than aperture 940 is placed on the bolt. The bolts 950 directly or via the washers 954 restricts the ability of each flange 930 to move upwards away from the support plate 902 and thereby restricts the range that the bearing support 904 can tilt relative to support plate 902 even when the load applied to the bearing support is not fully normal and a torque is introduced. The extent to which the rolling bearing 907 extends beyond the bottom surface 905 of the bearing support 904 and the tightness of the bolts can be selected to limit the range of tilt to a small enough amount to prevent the lower surface 905 of bearing assembly 904 from contacting the support plate 903 and allow substantially all of the load placed on the bearing support 904, e.g., by a mounted panel, to be transferred to the support plate 902 by the rolling bearing 907. For example, when the bolts 950 are provided with washers 954, the bolts can be tightened so that the head of the bolt holds the washer loosely against the respective flange 930 while allowing minimal vertical play.

The front of the bearing support 904 has an outward facing panel coupler 908 from which a panel can be hung. As noted, various panel coupler configurations can be used. In the illustrated embodiment, and with further reference to FIG. 9F, panel coupler 908 has a vertical track 910, such as a T-Track. A mating component 912 is attached to the panel, such as on transom portion 123. Mating component 122 has a correspondingly shaped extension 914, such as one having a T-shaped cross section. To mount the panel to the bearing support, the extension 914 is fitted into track 910 and secured in place, for example with a bolt 916 that passes through the cap 924 and threadedly engages aperture 960 in extension 914. Mating component 912 can be movably mounted to the panel. In an embodiment, mating component 912 is mounted to one or more horizontal bars 962 that slidably engage corresponding slots in the transom portion 123.

When a panel is mounted to the panel coupler the load from the panel is transferred from the bearing support through the bearing to the support plate. The bearing support can be locked in a default position, e.g., for transport, relative to the support plate by use of a locking pin. The locking pin can be removed before installation. Various locking pin configurations can be used. For example an additional aperture can be formed in one or both of the tabs 930 and a locking pin passed through such an aperture to engage a corresponding aperture in the support plate 902. (Not shown).

When a module 100 having a panel 120 hung from a bracket assembly mounted to the module is moved, such as when the module 100 is lifted by a crane at a building site, the lower part of the panel will tend to swing towards and away from the wall on which it is mounted. To address this, elastic spacer assemblies 305 can be mounted between a lower support of a panel and an opposing structure on the outward face of chassis 102 of a module 100.

Figure 3A:
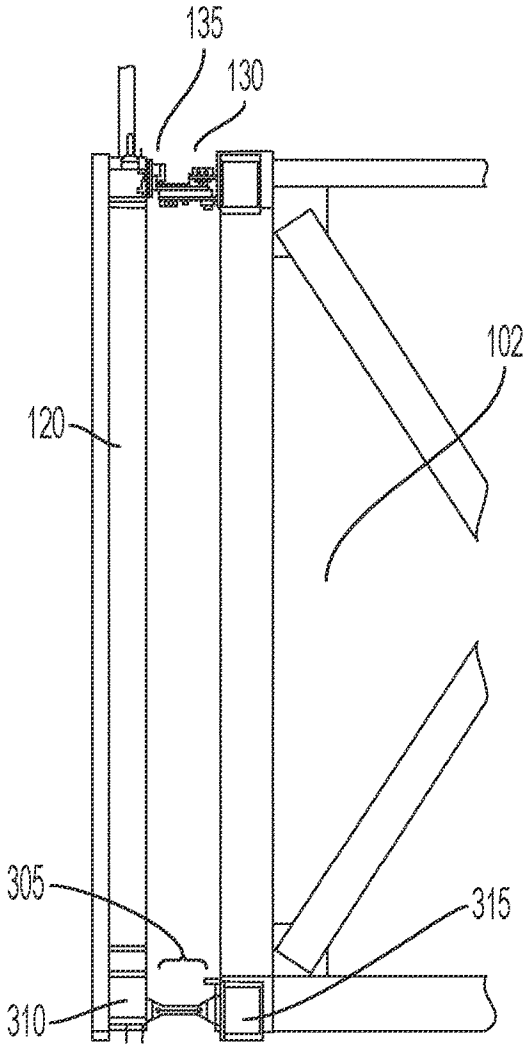
FIG. 3A is a vertical cross-sectional view of a panel mounted to a module chassis and having an elastic spacer assembly.

FIG. 3A is a cross section view of panel 120 attached using a bracket and hook assembly 130, 135 as discussed above. One or more elastic spacer assemblies 305 are connected between a bottom horizontal support 310 of the panel 120 and a suitably structural feature of on the module 100, such as a horizontal support member 315 at a bottom of a module chassis. Elastic spacer assembly 305 allows some movement of the bottom of the panel 120 relative to the chassis 102 while preventing the panel 120 from swinging freely. For example, the elastic spacer assembly 305 can be configured to urge the bottom of the panel 120 to a set position relative to the chassis 102 while allowing the panel 120 to swing in and out a predefined distance.

Figure 3B:
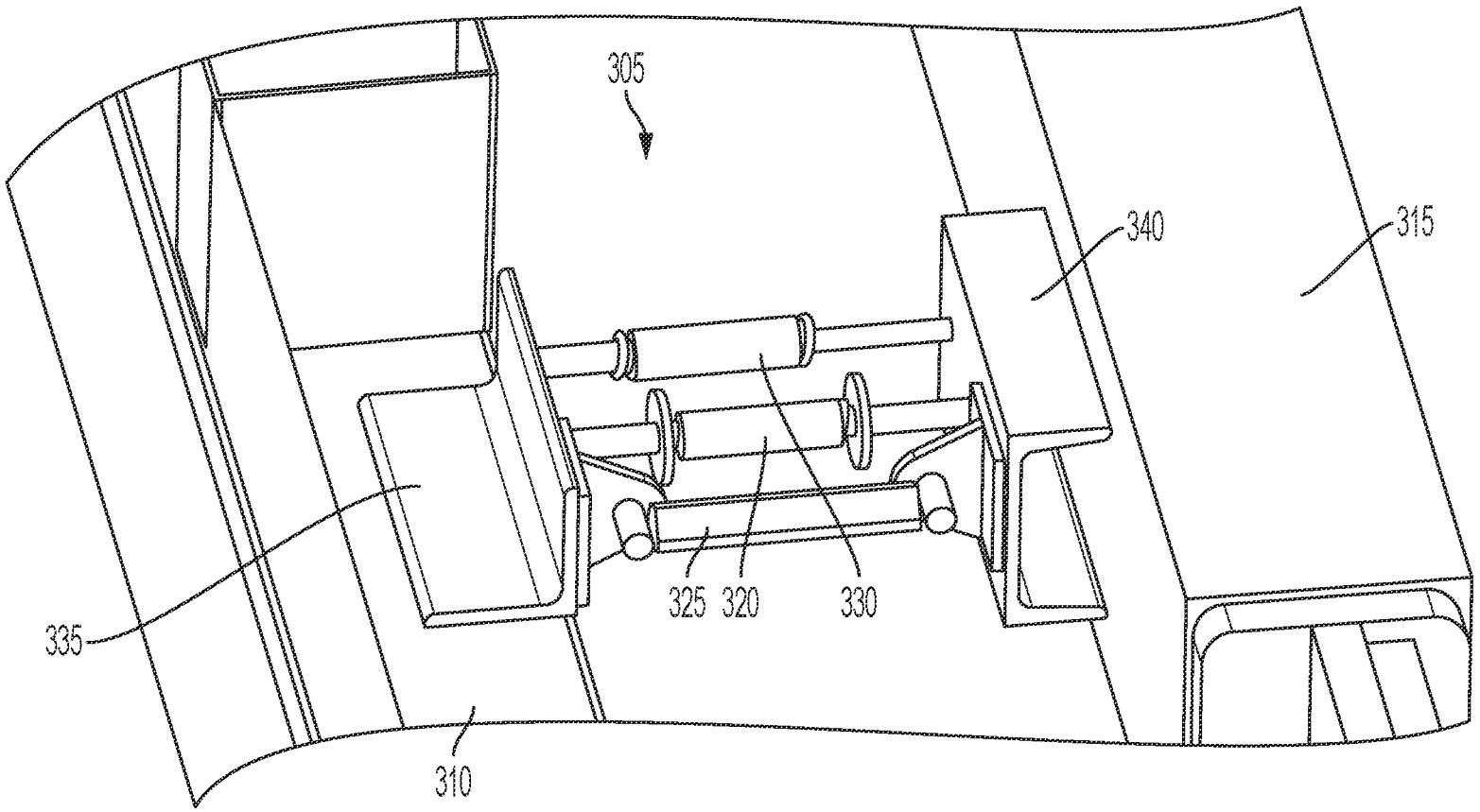
FIG. 3B is an illustration of an embodiment of the elastic spacer assembly of FIG. 3A.

FIG. 3B is an illustration of one embodiment of an elastic spacer assembly 305. The spacer assembly 305 comprises a compression spring 320, a tension spring 325, and a distance limiter 330. The components 320, 325, 330 are connected at an outer end to a first bracket 335 that is attached to the support 310 on the panel. The inner end of components 320, 325, 330 are connected to a second bracket 340 that is attached to the horizontal support 315 on the chassis 102. The brackets 335, 340 can be attached to their respective supports using conventional means, such as by welding, bolts, or other means known to those of skill in the art. While the spacer assembly 305 is shown as being attached to horizontal supports, they can alternatively be connected to any suitable support member on the panel 120 and chassis 102. In the illustrated embodiment, brackets 335 and 340 are L and U shaped, respectively. Alternative configurations can be used.

Figure 8:
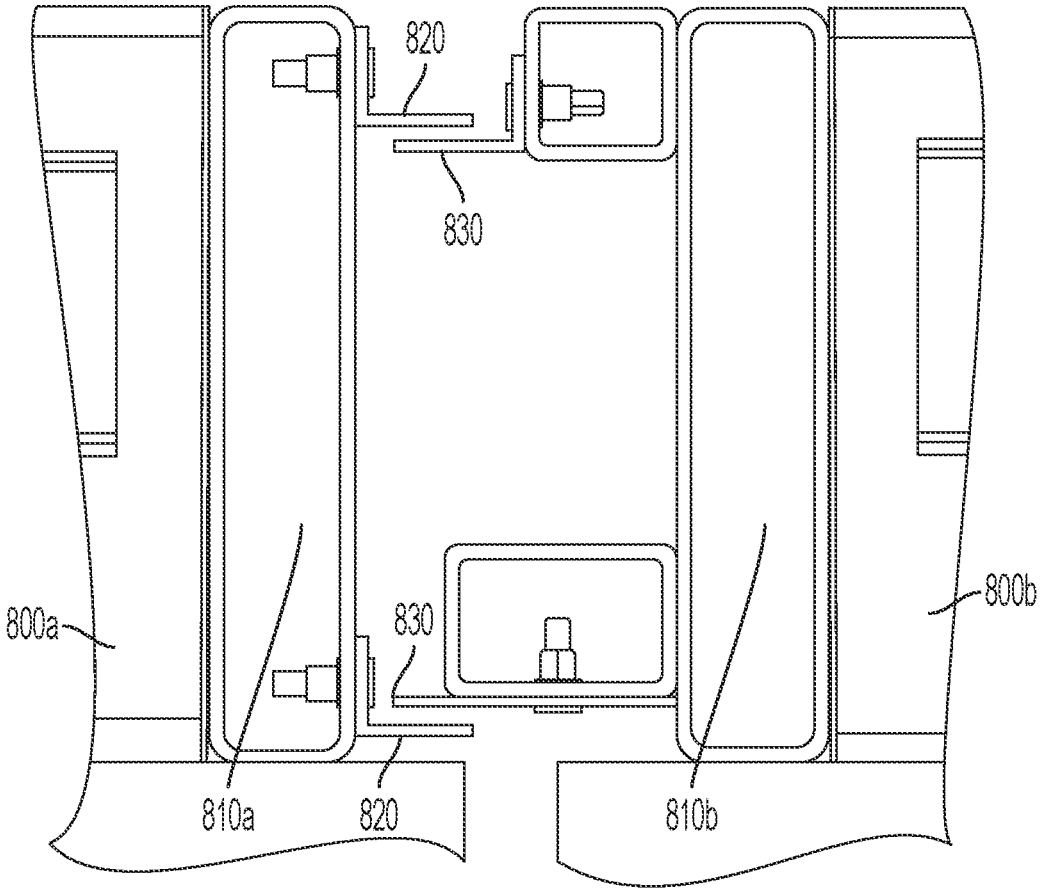
FIG. 8 PRIOR ART
FIG. 8 is a cross-section view of adjacent sides of a pair of mounted panels showing conventional panel alignment flanges.

There are various structures used to align a panel being installed relative to one already in place. FIG. 8 shows a top-down view of a junction between two adjacent panels 800*a*, 800*b* with a conventional panel alignment system. A first pair of alignment flanges 820 extend outward from the side 810*a* of the first panel 800*a*. A second pair of alignment flanges 830 extend outwards from the adjacent side 810*b* of the second panel 800*b*. The pairs of flanges 820, 830 can be affixed to the respective panel sides 810*a*, 810*b* by various means and can extend substantially the entire vertical length of the panel sides 810*a*, 810*b*. The pairs of flanges 820, 830 are positioned on the respective panel sides 810*a*, 810*b* so that when the panels 800*a*, 800*b* are aligned to be substantially co-planar, one pair of flanges will engage the other to help lock the position of the panel sides 810*a*, 820*b* in position. In the illustration of FIG. 8, one pair of flanges 830 fits between the other pair 820.

Panels generally need to be placed to a high degree of accuracy and an alignment system such as in FIG. 8 can require very tight placement tolerances, such as between 1-3 mm, for the pairs of alignment flanges to properly mate. Other interacting structures on adjacent panel sides may also require tight placement tolerances. As will be appreciated, when lowering panels into position on a building achieving such a tight placement tolerance can be difficult. When the panel is pre-attached to a prefabricated building module, the initial module placement relative to a previously placed neighbor module may only be within a larger horizontal placement tolerance, such as 10 mm, as the module is lowered into place. This tolerance is insufficient for proper mating of adjacent panels.

Figure 4A:
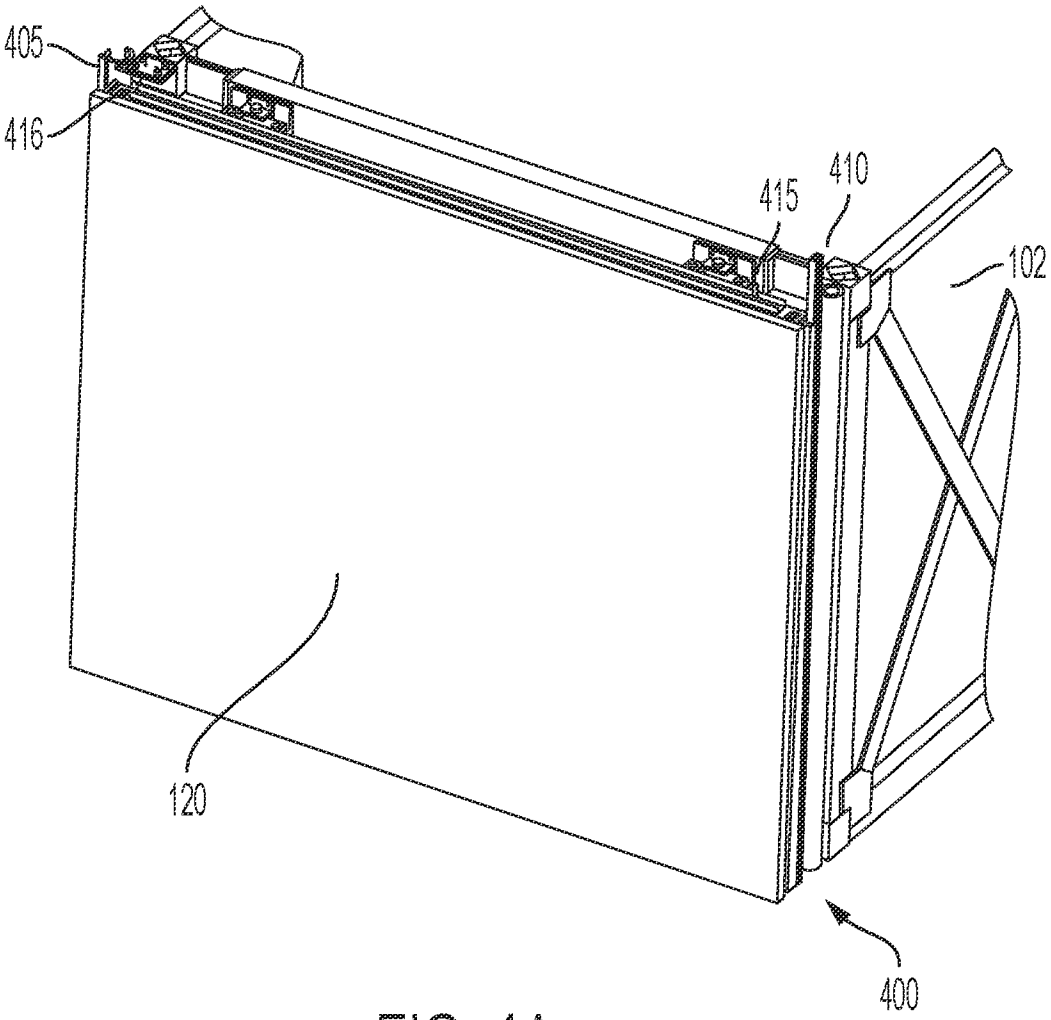
FIGS. 4A-4E are illustrations of left and right mullion guides mounted to a panel on a module chassis.
Figure 4B:
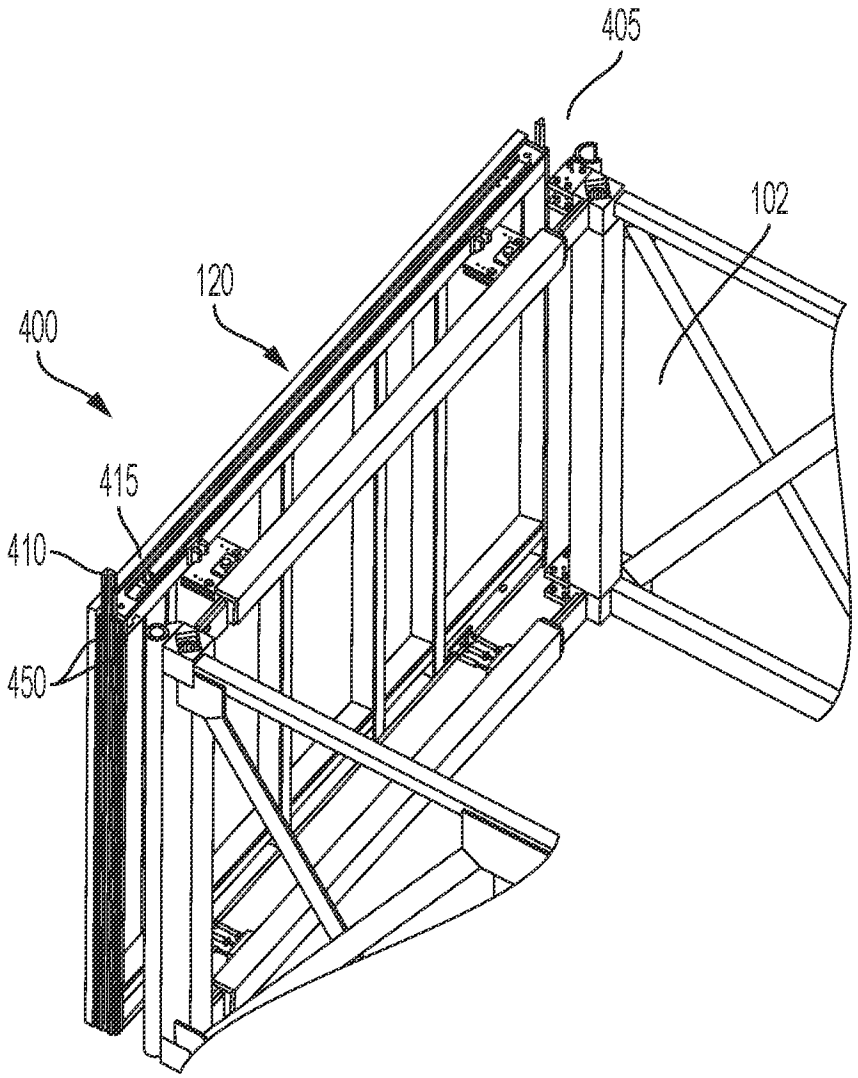
Figure 4C:
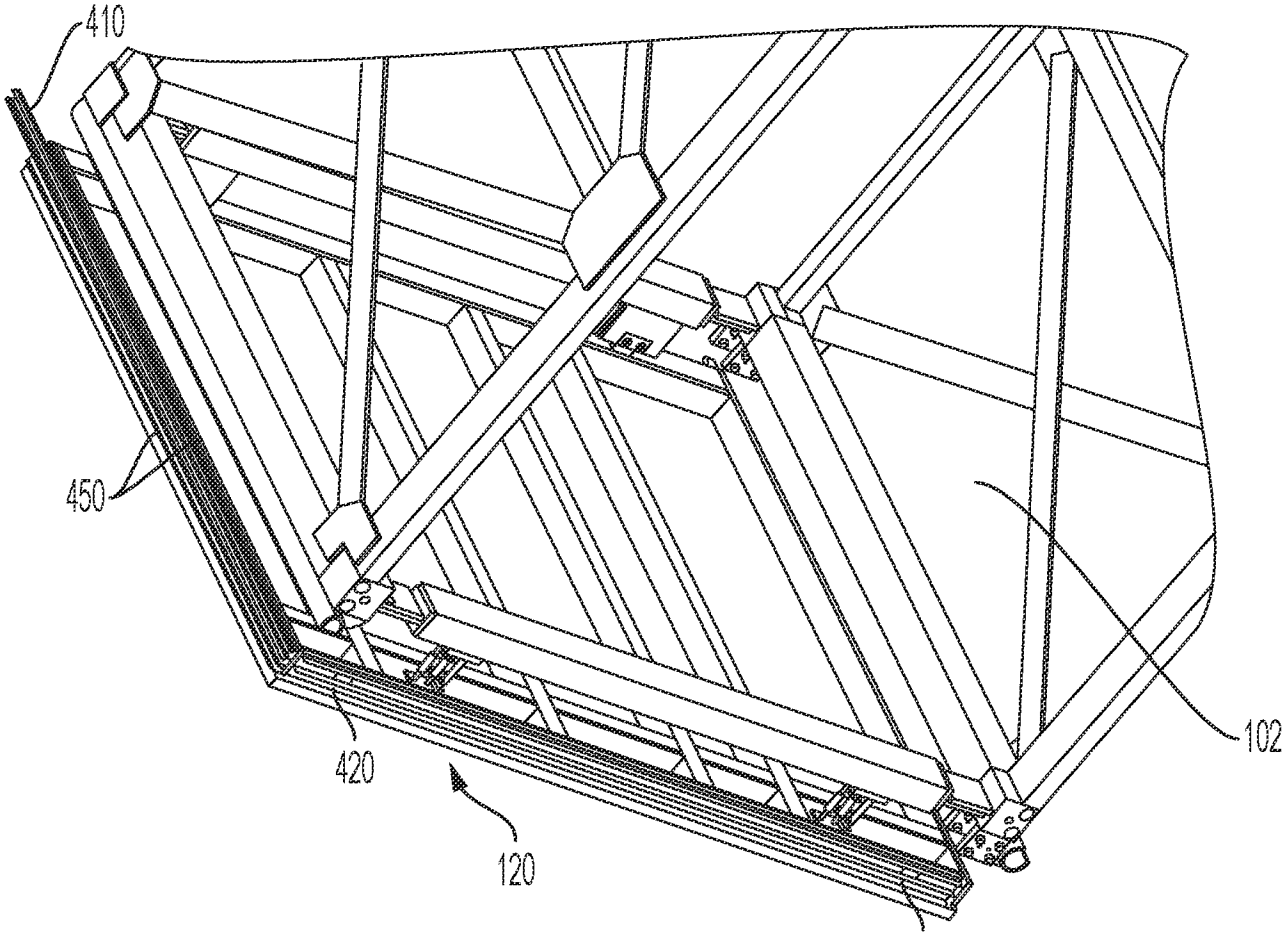
Figure 4D:
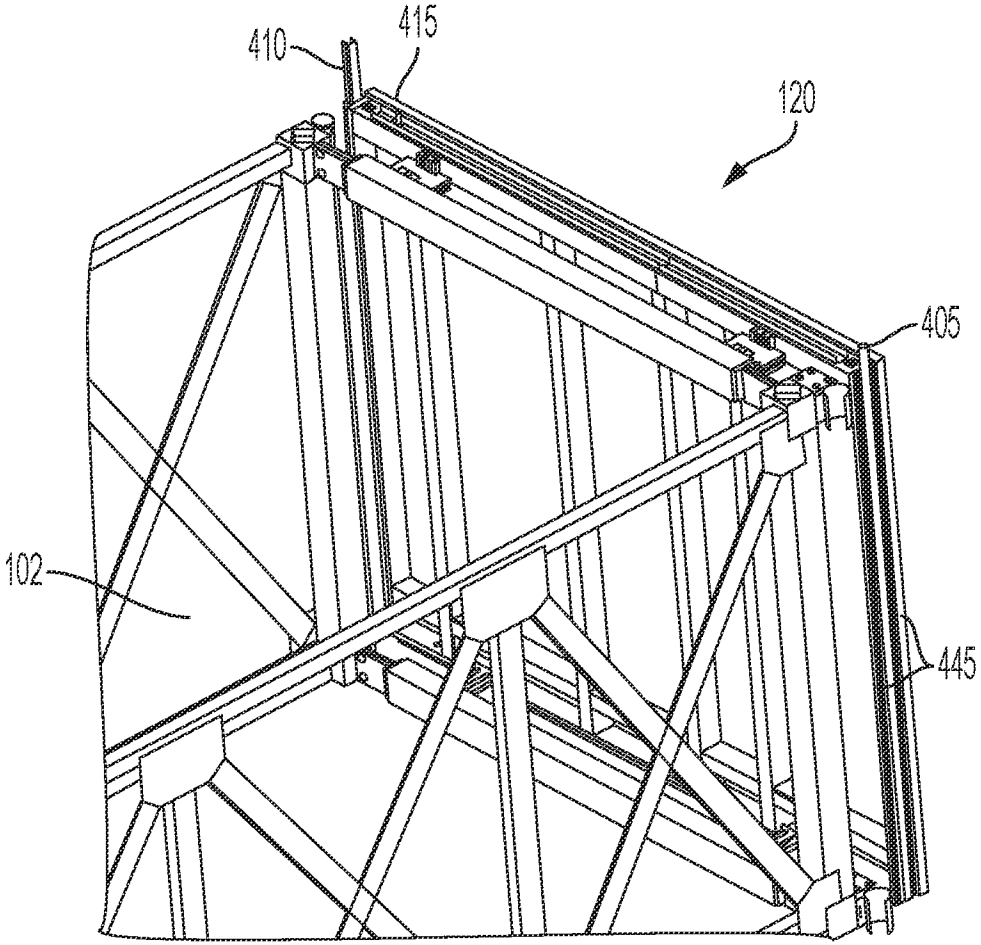
Figure 4E:
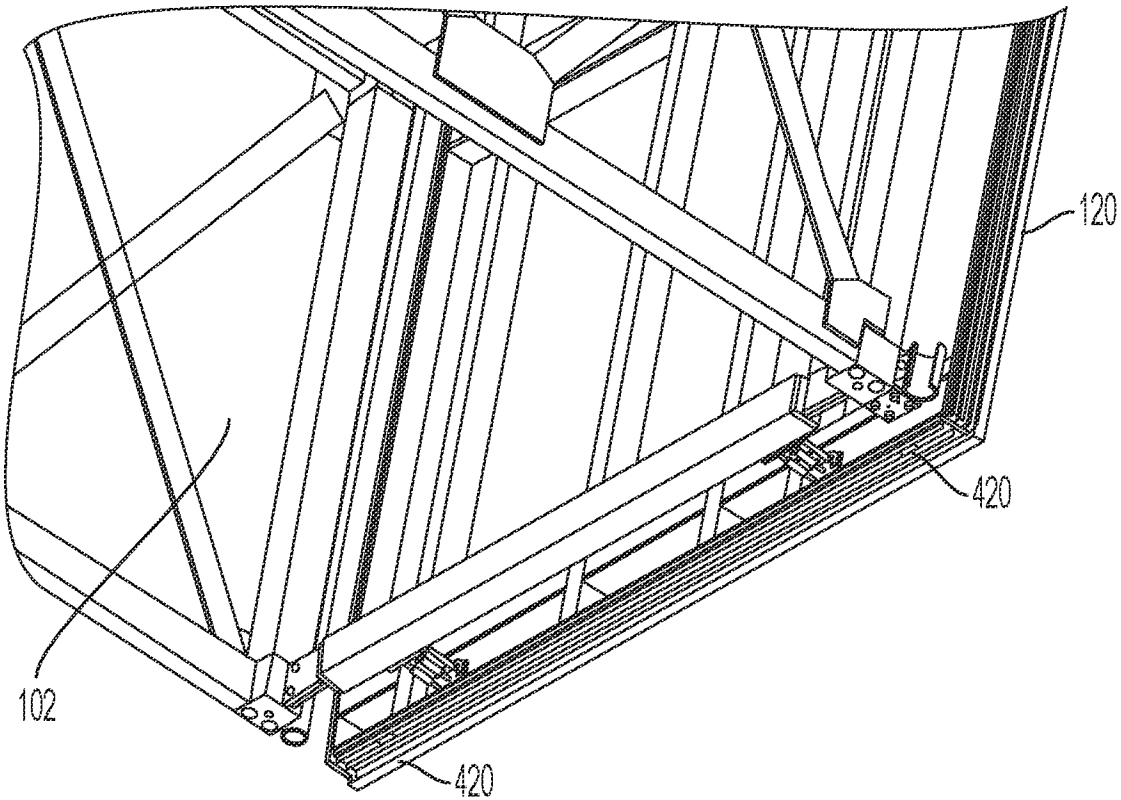

According to a further aspect of the invention, a panel guide system is provided which operates to automatically adjust alignment of a panel being lowered into place from a first large alignment tolerance, such as 10 mm, down to a second much tighter tolerance, such as 1-3 mm, as the panel being lowered begins to interact with a previously placed panel. Turning to FIGS. 4A—4E there is shown a panel guide system 400 which can be used in connection with the panel mounting system 125 addressed herein. FIG. 4A is a front perspective view of a panel 120 mounted to a module chassis 102 illustrating the placement of mullion guides 405, 410 and upward facing alignment pin 415. FIG. 4B is a top perspective view of the configuration of FIG. 4A showing the right mullion guide 410 and top of the panel 120. FIG. 4C is a bottom perspective view of the configuration of FIG. 4A showing the right mullion guide 410 and bottom of the panel 120. FIGS. 4D and 4E are similar respective top and bottom perspective views showing the left mullion guide 405.

The panel guide system 400 comprises left and right mullion guides 405, 410 configured to interlock and operative to self-align a side of panel being lowered in place (in combination with a module 100 or as a discrete component) with the adjacent side of an already placed panel. The mullion guides 405, 410 can be positioned on the vertical sides of the panels and can work in conjunction with conventional tight-tolerance alignment components. In the illustrated embodiment, mullion guides 405, 410 are positioned between respective pairs of alignment flanges 445, 450. An alignment pin 415 and alignment aperture 420 can be provided further align the free side of the panel being placed as it is lowered into its final position.

As discussed more fully below, and with further reference to FIG. 1A, the mullion guides 405, 410 are can be configured so the top of the mullion guide 410 on the leading side of an already placed first panel 120*b* extends above the top of that panel and has a first alignment mechanism formed in that extension. The mullion guide 405 on the adjacent side of the panel being placed 120*a* has a second alignment mechanism formed at the bottom of guide 405 near a corner of the panel 120*a*. As panel 120*a* is lowered into place, the first alignment mechanism at the top of mullion guide 410 engages mullion guide 405 and operates to align mullion guide 405 in a first horizontal direction, such as substantially normal to the plane of the panel 120*b* (e.g., inward and outward from the building). The second alignment mechanism at the bottom of mullion guide 405 engages mullion guide 410 and operates to align mullion guide 405 in a second horizontal direction substantially orthogonal to the first direction, such as substantially parallel to the plane of the panel 120*b* (e.g., left and right along the face of the building). The first and second alignment mechanisms can be configured to bring the placement tolerance of the panel being lowered from a large initial tolerance, such as 10 mm, to a tighter tolerance needed for other interlocking components on the adjacent panel sides, such as flange pairs 445, 450 with a tolerance of 1-3 mm, before the panel is lowered to the point that such other interlocking components interact.

As the bottom of panel 120*a* gets near the top of the lower panel 120*c*, the alignment aperture 420 on the bottom of the panel 120*a* mates with the corresponding alignment pin 415 on the top of the lower panel 120*c* attached to the module 100*c* on which the module being placed 100*a* will rest to align the free side of the panel 120*a*. After module 100*a* is fully seated and the panel 120*a* aligned, the position of the panel 120*a* can be locked in place, for example by locking supporting bracket assemblies 135 as discussed above.

For the initially placed module 100 in a row, such as modules 100*b* and 100*d* in FIG. 1A, a mullion guide is only needed on the leading edge of the panel 120 where a next panel will couple. In addition, the panels on such modules, such as panels 120*b* and 120*d*, can be fitted with both a left and a right upward facing alignment pin 415. The pair of alignment pins 415 are used to align the panel 120 on the next vertically stacked initial row module 100 in lieu of aligning a panel edge with the adjacent edge of the previously placed horizontal panel. Thus, panel 120*d* will have left and right alignment pins 415 and these are used to align the base of the panel 120*d* when module 100*b* is put in place on top of module 100*d*.

Figure 4F:
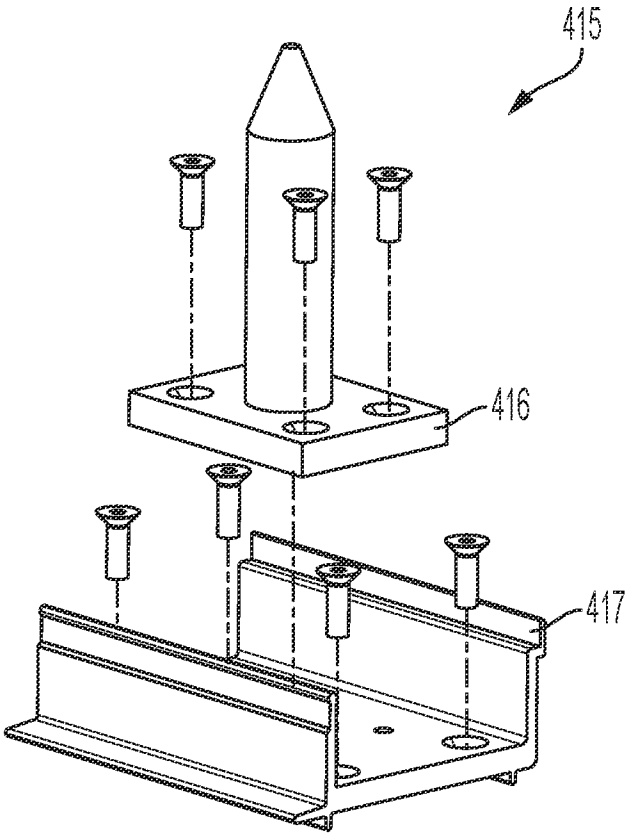
FIG. 4F is an illustration of a locking pin.
Figure 5A:
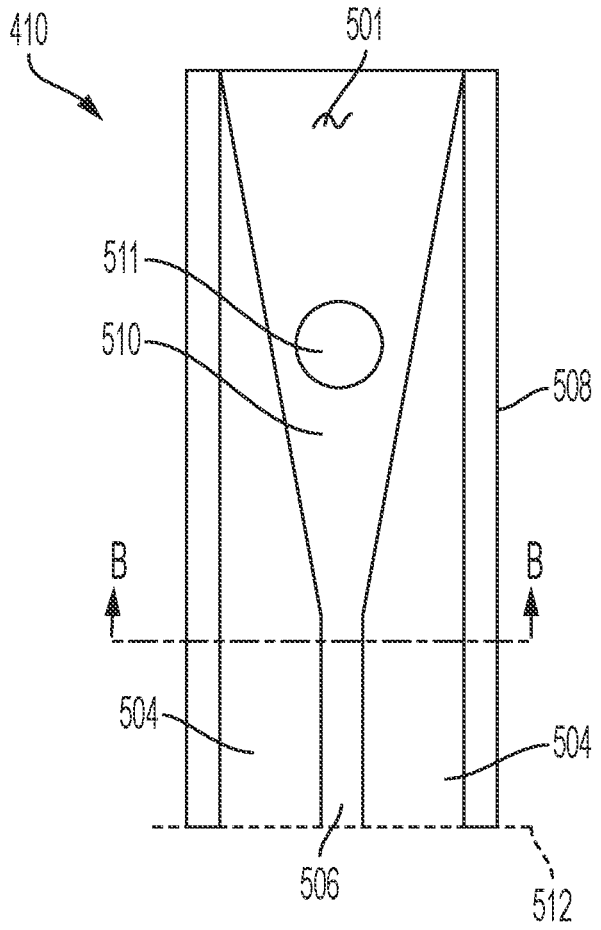
FIGS. 5A-5D are side and cross-section views of the left and right mullion guides shown in FIGS. 4A-4E.
Figure 5B:
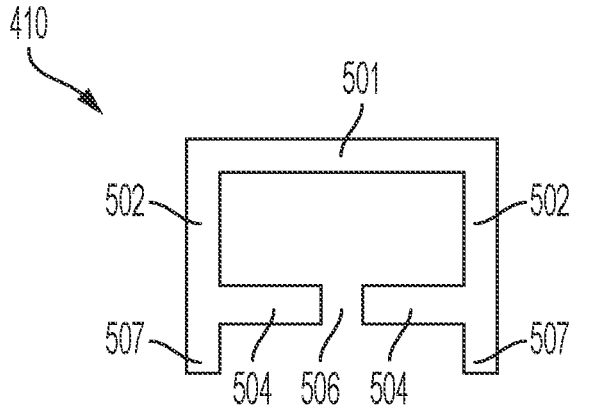

The mullion guides 405, 410 can be removable allowing them to be easily mounted on the proper panel sides for left-to-right or right-to-left installation. In addition, mullion guides 405, 410 can be configured to allow removal after serving their panel alignment function. Once removed, mullion guides 405, 410 can be installed on other panels. The alignment pins 415 can also be removable and configured to attach to a left or right alignment pin mounting 416 so that the alignment pin 415 can be easily mounted on the appropriate left or right position on top of the panel 120. In one configuration, and as shown in FIG. 4F, alignment pin 415 can extend upward from a base plate 416 which can be mounted to a guide pin plate 417 affixed or formed on the top edge of the panel 120 in the appropriate location. Other mechanisms for mounting the alignment pin 415 can alternatively be used FIG. 5A is a side view of a top portion 508 of right mullion guide 410 with a first alignment mechanism. FIG. 5B is a cross-section view of right mullion guide 410 through line B-B. Turning to FIGS. 5A and 5B, right mullion guide 410 is a generally elongated member having a main body with a back wall 501 which can be attached to the side of a panel 120. Opposing side walls 502 extend outward from the back wall 501. Opposed flange walls 504 extend from the respective side walls 502 towards each other. The flange walls 504 define an intermediate channel 506. Additional extensions 507 of the side walls 502 can be formed outward of the flange walls 504. At the top portion 508 of the mullion guide 410 the inward length of the flange walls 504 from the side walls 102 decreases so that intermediate channel 506 opens up to form a funnel shaped channel portion 510 at the upper end of the channel 506. As discussed further below, the funnel portion 510 is operative to capture a portion of the mullion guide 405 and align it within the channel 506 as the mullion guide 405 is lowered past the top 508 of mullion guide 410.

Figure 5C:
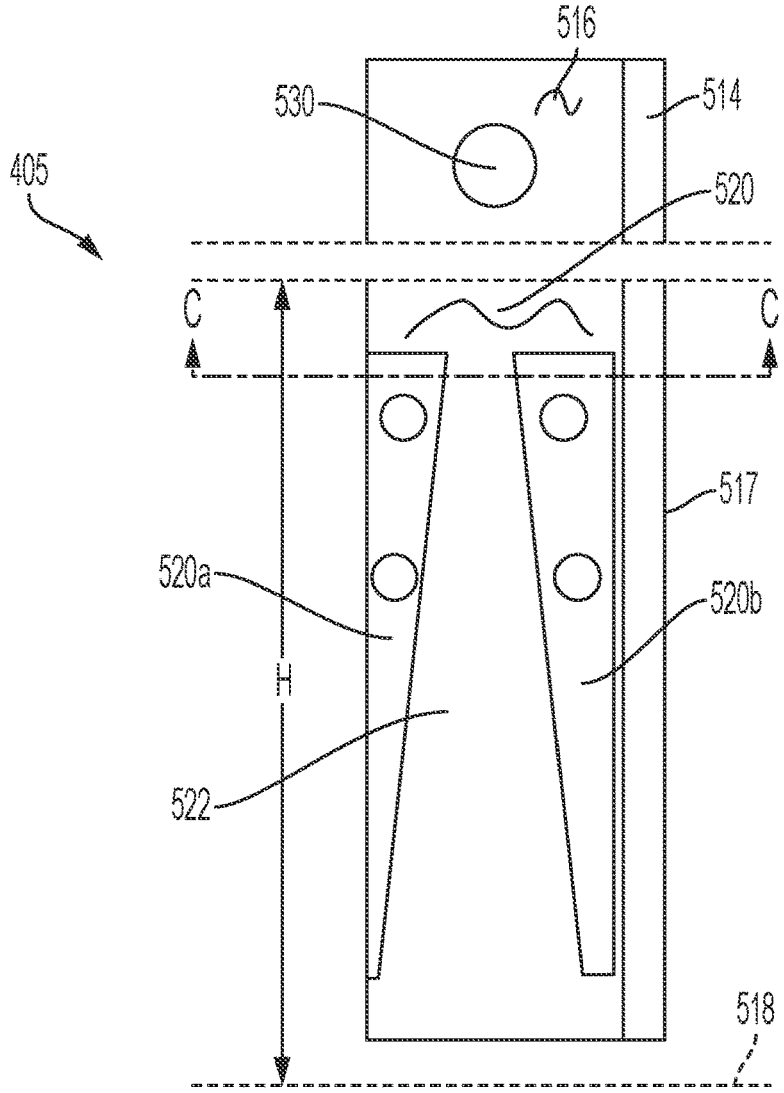
Figure 5D:
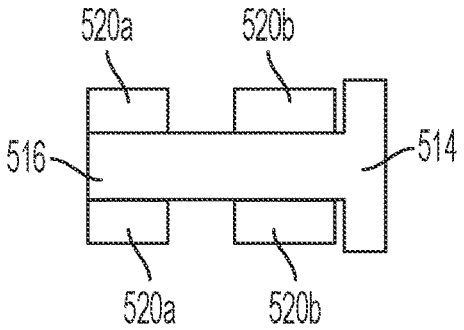

FIG. 5C is a side view of the left mullion guide 405. FIG. 5D is a cross-section view of left mullion guide 405 through line C-C. Left mullion guide 405 has an elongated body comprising elongated wall 516. When the mullion guide 504 is installed on the side of a panel 120, wall 516 will extend outwards from the side of the panel and be generally parallel to a plane defined by the front face of that panel. 120. In the illustrated embodiment, the left mullion guide 504 has a generally T shaped cross-section along its length where the wall 516 forms the stem of the T and extends outwards substantially perpendicularly to the top portion of the T 514.

The second alignment mechanism comprises at least one guide 520 positioned on the wall 516 at or near the bottom of 517 of mullion guide 405. In the embodiment illustrated, there is a guide 520 on opposing sides of wall 516. Each alignment guide 520 is configured to define a tapered channel 522 narrowing upwards along the vertical axis of the mullion guide 405 In the illustrated embodiment, each alignment guide 520 comprises first and second wedge shaped blocks 520*a*, 520*b* which are affixed to the sides of the wall 516 as illustrated. Blocks 520*a*, 520*b* can be symmetric, such as triangular, or differently shaped as illustrated wherein outer block 520*a* (furthest from portion 514) is generally triangular while an inner block 520*b* is trapezoidal. Other configurations are possible. While alignment guide 520 is illustrated as being formed of separate blocks 520*a*, 520*b*, alignment guide could also be a single integral component attached to the wall 516. As discussed further below, the tapered channel 522 is operative to capture a portion of the mullion guide 510 and align it within the channel 522 as the mullion guide 405 is lowered past the top 508 of mullion guide 410.

The mullion guide 405, 410 can be made of steel or other suitable material. The setting blocks 520 on the left mullion guide 405 are preferably made of rigid material such as plastic, for example Teflon™. Other rigid plastics or other materials, including metals, could be used instead. It is also possible for setting blocks 520 to be formed integrally with the mullion guide 405.

The mullion guides 405, 410 can be attached to the side of a panel 120 in a variety of ways. A particular mounting arrangement is discussed below. For mullion guides that are removable after panel placement, suitable attachment points can be provided to allow use of a rope or cable to help lift the guides 405, 410 out from between adjacent edges of placed panels, such as aperture 511 in guide 410 and aperture 530 in guide 405 (FIGS. 5A, 5C).

Figure 6A:
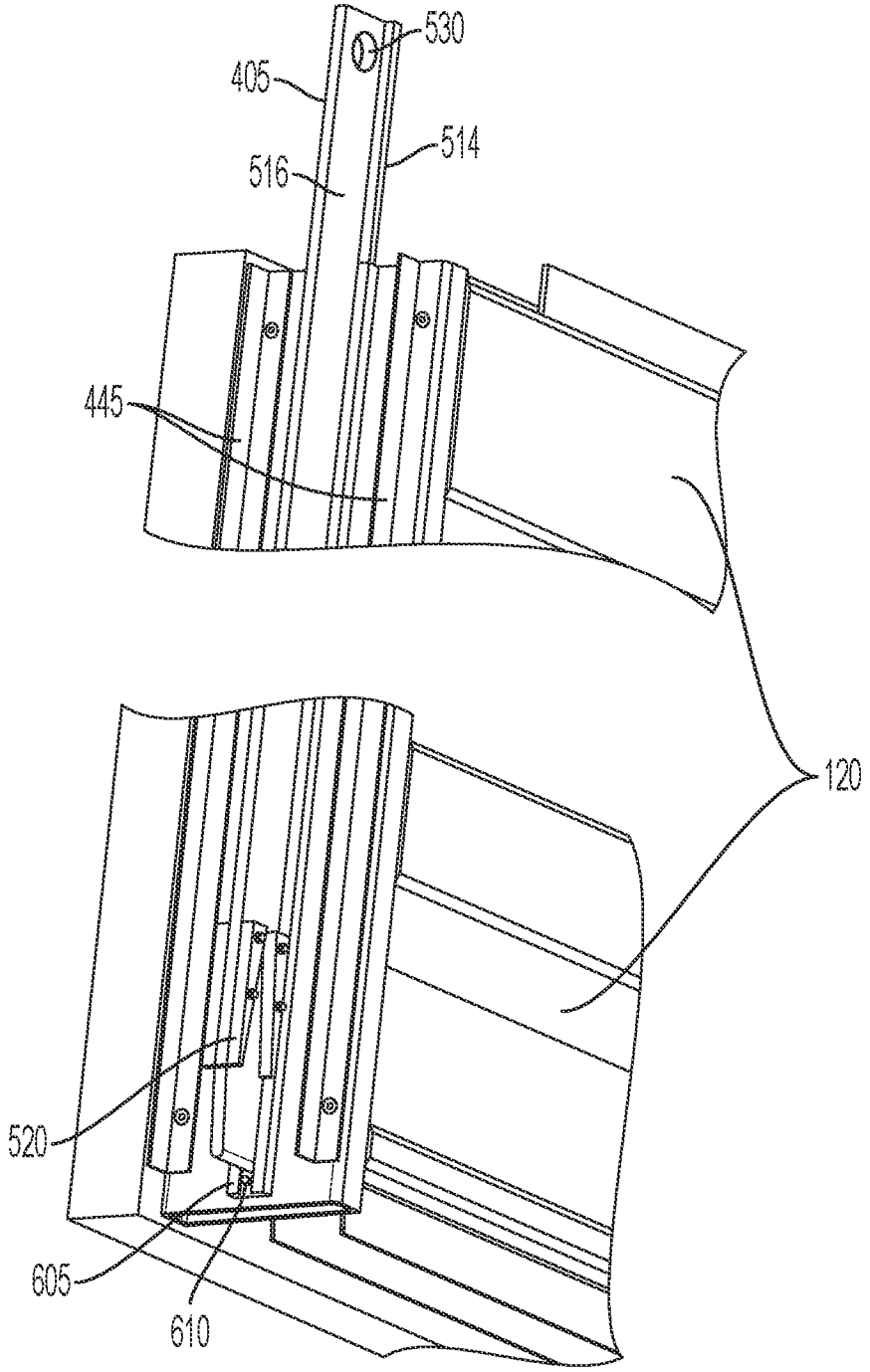
FIGS. 6A-6B and 6C-6D are perspective and cross-section views of left and right mullion guides, respectively installed on a panel, according to an embodiment.
Figure 6B:
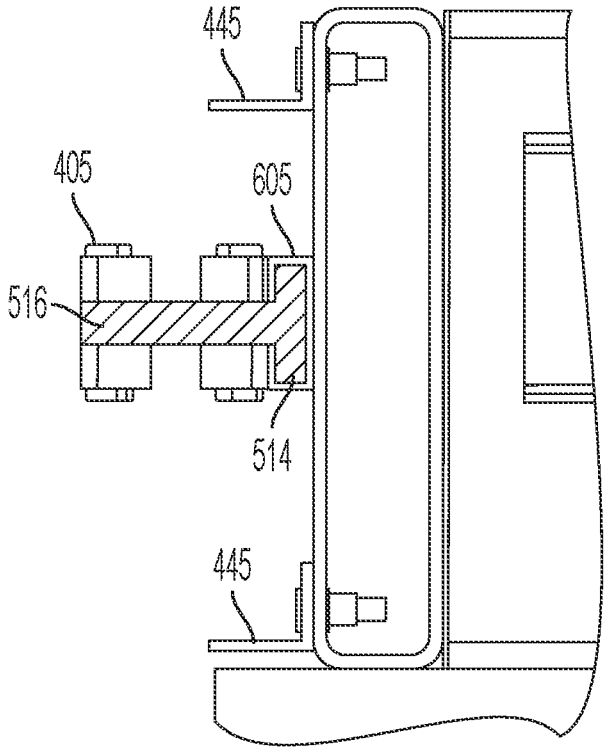

FIG. 6A shows a broken perspective view of a side of a panel 120 having mullion guide 405 mounted thereto. FIG. 6B is a horizontal cross section through the setting blocks 520. In this embodiment, mullion guide 405 slidably engages a track 605 that is mounted vertically along the side of the panel and which can be placed between the pair of alignment flanges 445. For a T-shaped mullion guide 405 as shown herein, track 605 can be a C-shaped track that captures the arms on the top portion 514 of the T. Depending on the configuration of mullion guide 405, different track configurations may be used. A set screw 610 placed in the track 605 at the bottom prevents the mullion guide 405 from sliding past it. A locking screw (not shown) can be used to fasten the mullion guide 405 at the top of the track 605.

Figure 6C:
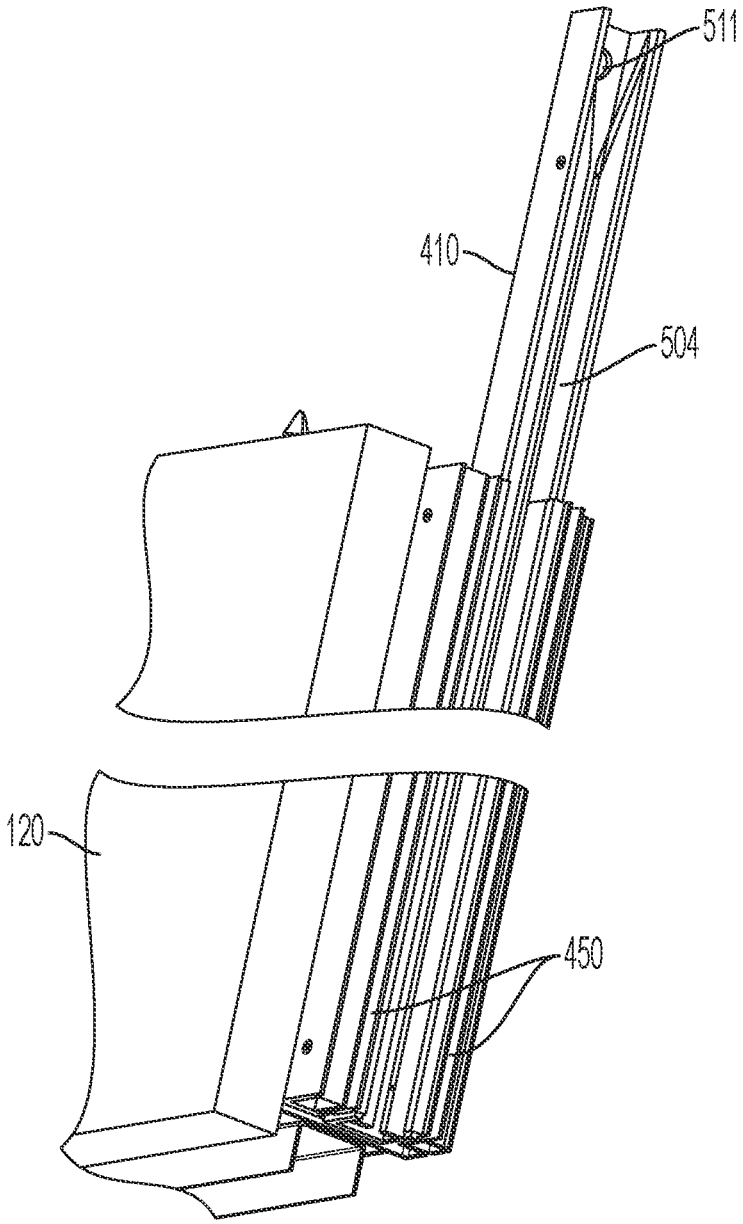
Figure 6D:
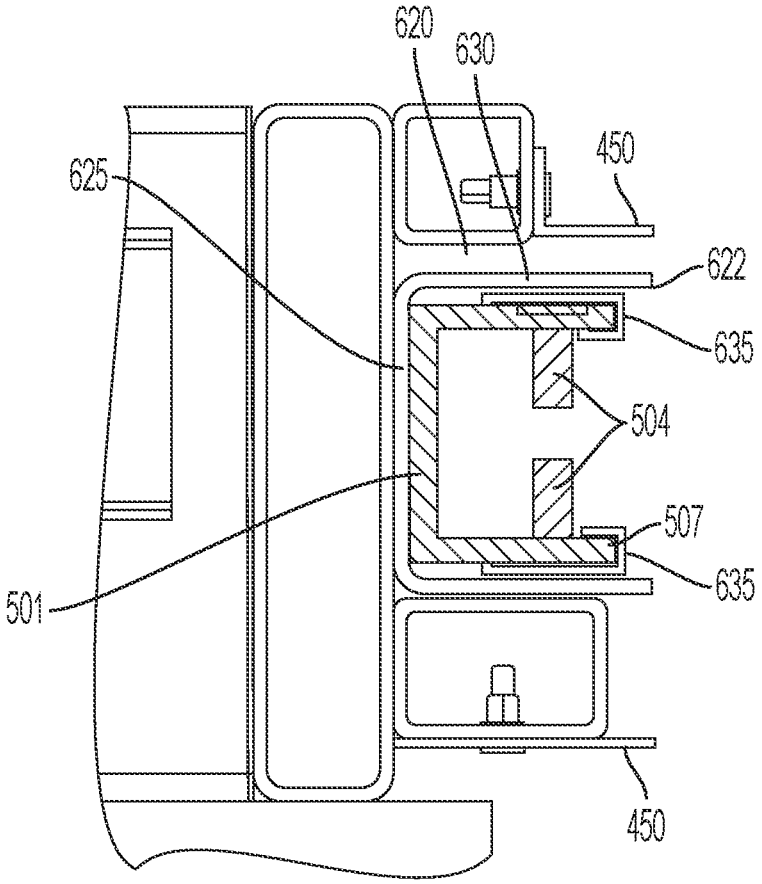

FIG. 6C shows a broken perspective view of a side of a panel 120 having mullion guide 410 mounted thereto. FIG. 6D is a horizontal cross section through the setting blocks 520. In this embodiment, mullion guide 410 slidably engages a track 620 that is mounted vertically along the side of the panel and which can be placed between the pair of alignment flanges 450. In the disclosed embodiment, track 620 is comprised of a U-shaped channel 622 with a base 625 attached to the side of the panel and arms 630 extending outward therefrom. A pair of J-shaped channel members 635 are attached inside the arms 630 and configured to capture the extensions 507 on the mullion guide 410 while the back 501 of mullion guide 410 rides against the base 625 of the channel 622. While channel members 635 are illustrated as being separate from the U-shaped channel 622, other configurations can be used. For example, the outer ends of channel 622 can be rolled inwards to form a capture area for extension 507. A set screw (not shown) placed in the track 620 at the bottom prevents the mullion guide 410 from sliding past it. A locking screw (not shown) can be used to fasten the mullion guide 410 at the top of the track 620. Depending on the configuration of mullion guide 410, different track configurations may be used.

Figure 7A:
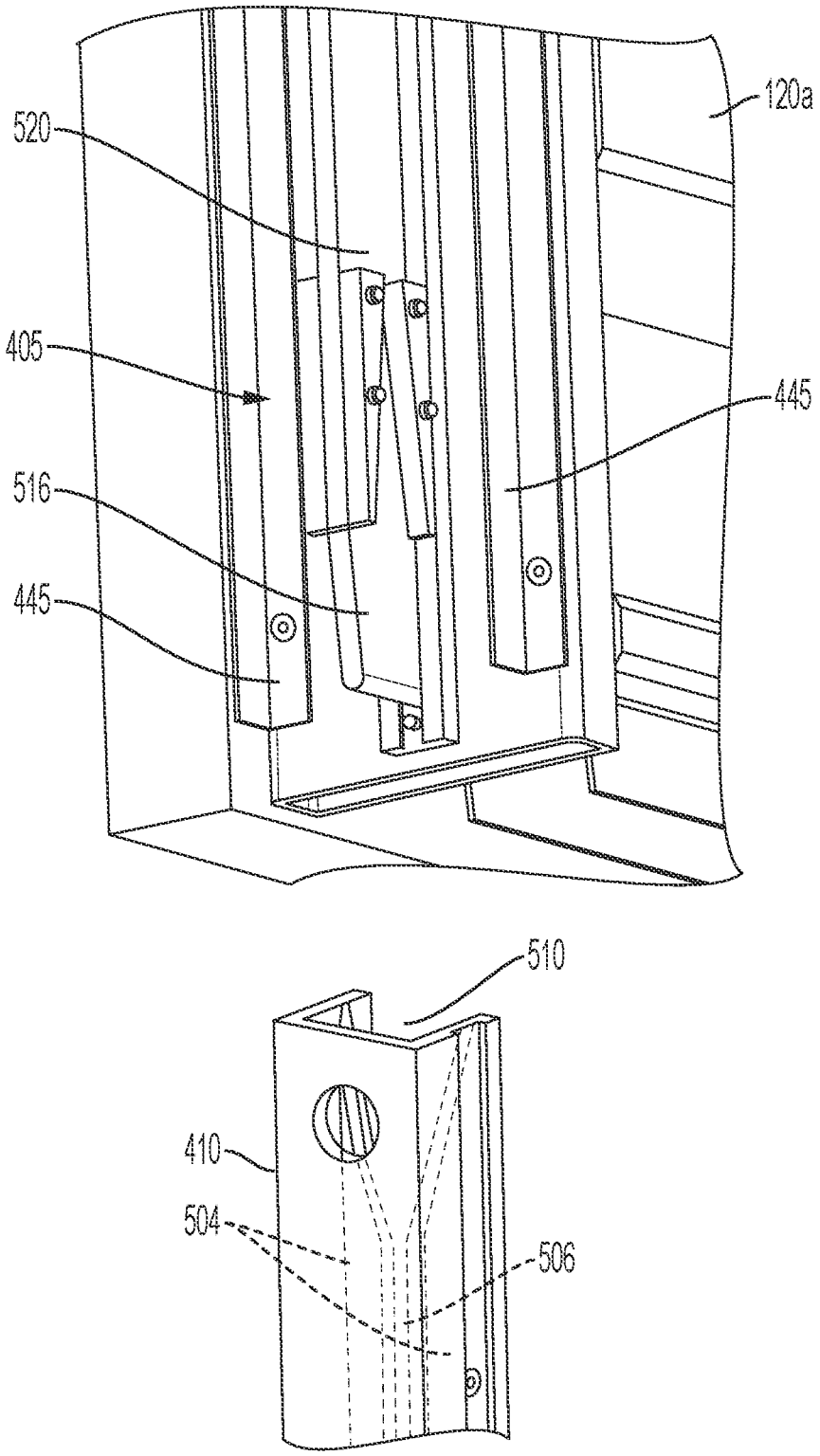
FIGS. 7A-7B illustrate a left and right mullion guide positioned just prior to interaction.
Figure 7B:
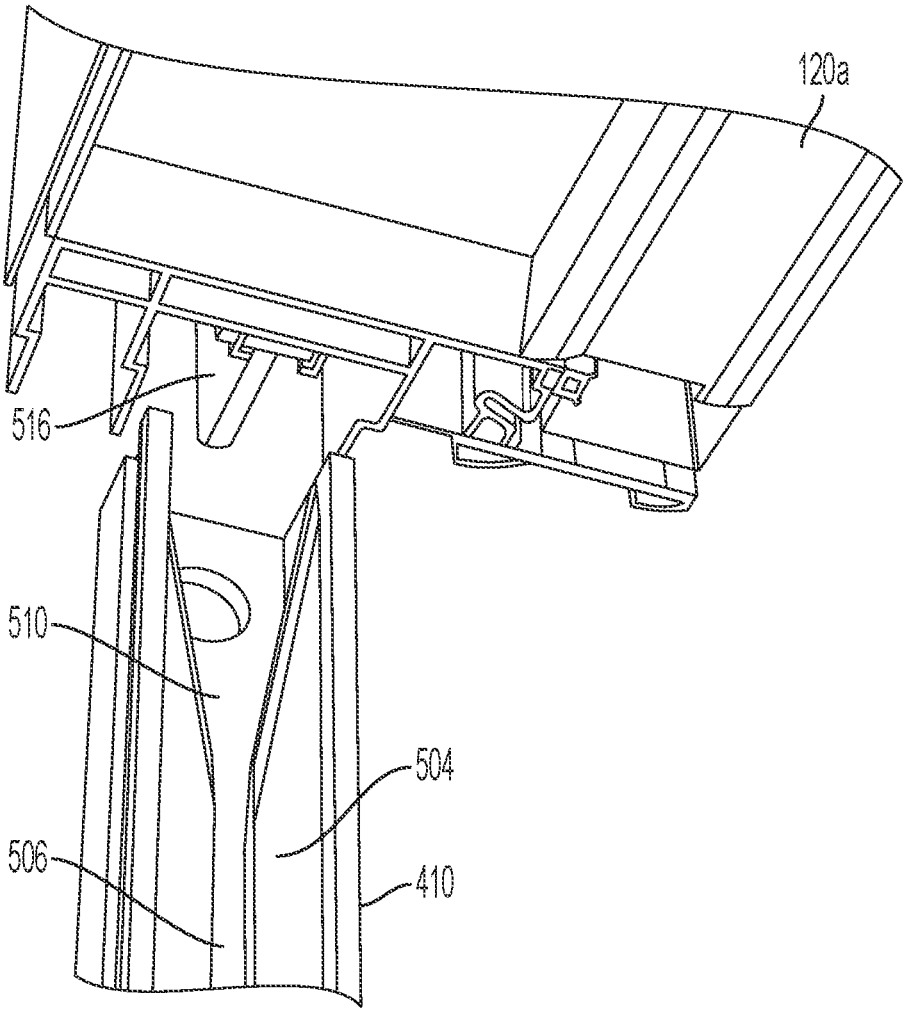
Figure 7C:
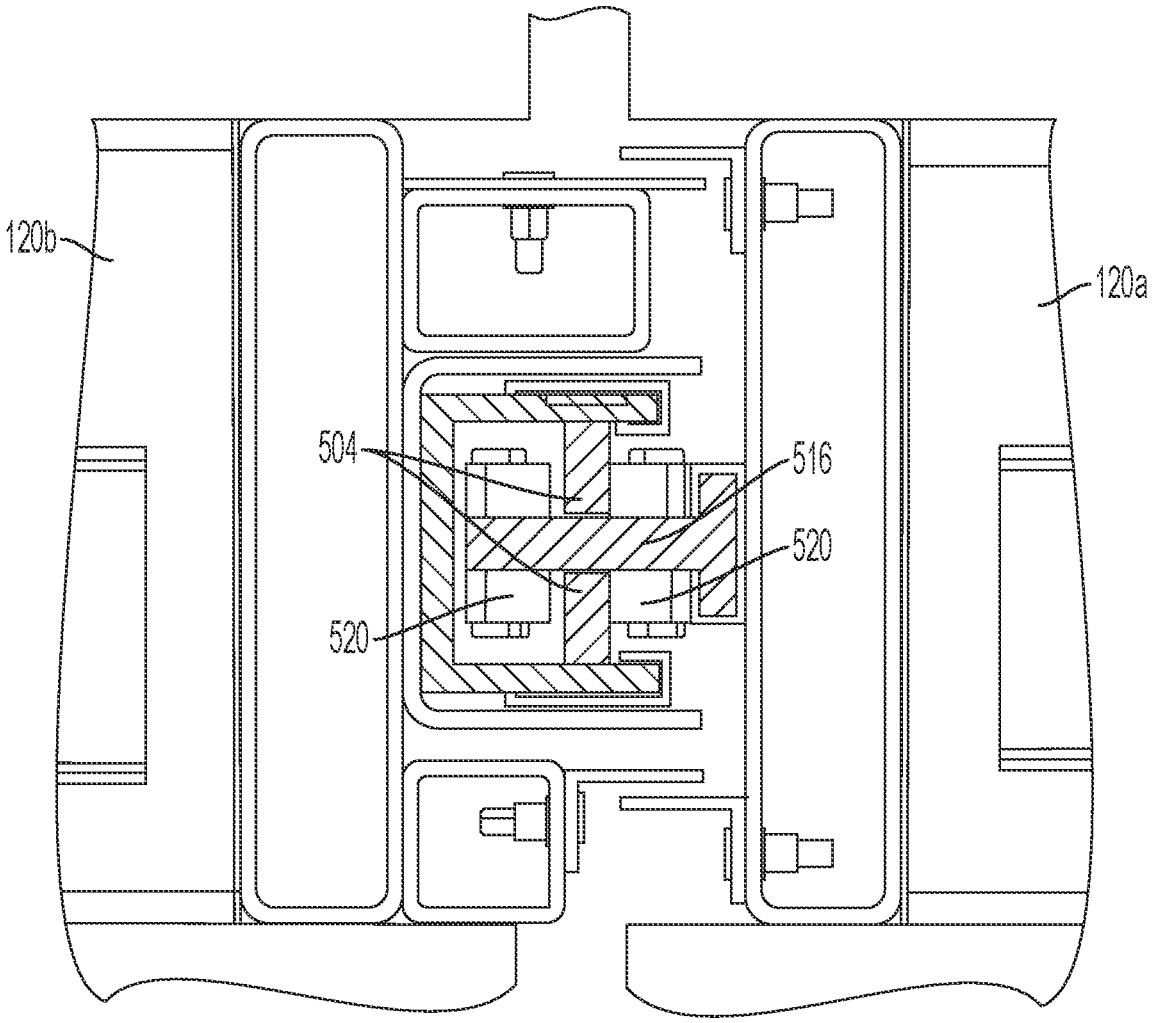
FIG. 7C is a cross-section view showing the alignment mechanism on each mullion guide fully engaged with structure of the other mullion guide between two adjacent panel sides.

As further illustrated in FIGS. 7A-7C, the alignment mechanisms on the mullion guides 405, 410 operate to align mullion guide 405 in the horizontal axes parallel and perpendicular to the plane defined by the panel face as each alignment mechanisms interacts with a portion of the other mullion guide. FIGS. 7A and 7B are perspective views of the mullion guides 405, 410 just before they interact. FIG. 7C is a cross-section view showing the alignment mechanism on each mullion guide fully engaged with the structure of the other mullion guide. With reference to these figures, when a panel, such as panel 120*a* on module 100*a*, is lowered into place, the panel 120*a* is positioned so that the stem 516 of the left mullion guide 405 will enter the funnel portion 510 of channel 506 at the top of the right mullion guide 410 which is affixed to extends above panel 120*b* on module 100*b*. As the panel 120*a* is further lowered, channel portion 510 on the right mullion guide 410 guides stem 516 of the left mullion guide 405 into the main channel 506 of the right mullion guide 410 thereby automatically aligning the panel 120*a* in a front to back direction. Also as the panel 120*a* is lowered, the flanges 504 on the right mullion guide 410 are captured by alignment guide 520 at the bottom of the left mullion guide 405 which operates to automatically aligns the bottom of the panel left-to-right as the panel is further lowered In a preferred embodiment, the alignment mechanisms on the mullion guides are configured to accommodate a relatively large placement tolerance of module 100*a* in its initial position, such as a tolerance of 10 mm. As a result, so long as the initial alignment of the module 100*a* is within the large design tolerance range, the module can be lowered and the panel will automatically align to the smaller tolerance of other panel coupling features, such as between 1-3 mm. If the panel 120*a* is mounted to a module using the bracket assembly 130 discussed above, the anchor plate 245 will move to accommodate positional adjustments of the panel from the larger tolerance range of the initial module placement to the tighter tolerance range of other coupling features on the panels. Once the panel is fully seated, the anchor plate 245 can be locked into position as discussed above.

In addition, once the panel is fully seated the slidably mounted mullion guides 405, 410 on the adjacent panel edges can be removed from the respective panels. To accomplish any locking screw or other locking member used to hold the mullion guides 405, 410 in place are removed. Such locking members should be positioned at the top of the mullions in a location that can be accessed after the panels are positioned. Once the locking members are removed, the mullion guides 405, 410 can be pulled upwards in their respective tracks 605, 620, for example by using ropes or cables attached to the respective apertures 530, and 511 at the top of mullion guides 405, 410.

The easy mounting and removability of the mullion guides 405, 410 allows the mullion guides to be temporarily installed on the sides of panels and then removed after the panels have been placed in the building and reused on other panels. In addition, it is easy to mount the mullion guides as appropriate for the direction in which modules/panels are being placed.

The mullion guides 405, 410 are described herein as left and right mullion guides for convenience. The position of guides 405, 410 position on a panel 120 can be reversed if the modules 100 are being stacked right to left instead of left to right. In such a case, mullion guide 405 would be attached to the right side of the panel 120 and mullion guide 410 attached to the left side of the panel 120. The alignment pin 415 would also be mounted on the left instead. Panels can be provided with left and right alignment apertures 420 to accommodate alignment pins 415 in either location.

While the right and left mullion guides 410, 405 are described herein as having particularly structured first and second alignment mechanisms, other configurations are possible. For example instead of the alignment mechanism on mullion guide 410 operative to align mullion guide 405 front to back while the alignment mechanism on mullion guide 405 is operative to align it left and right, the alignment mechanisms can be rearranged to switch the direction of alignment provided by each.

While the panel guide system 400 as disclosed herein is preferably used in conjunction with panels 120 that are pre-mounted to a prefabricated module 100, the guide system 400 may also be used on panels that are separately mounted to the exterior of a building structure, and whether or not that building is made of prefabricated modules or a conventional girder framework. The panel guide system 400 can be used on panels mounted to a module 100 using panel mounting system 125 as disclosed herein or with panels mounted to a module 100 or other building structure in another manner.

Various aspects, embodiments, and examples of the invention have been disclosed and described herein. Modifications, additions and alterations may be made by one skilled in the art without departing from the spirit and scope of the invention as defined in the appended claims.

The invention claimed is:

1. A panel alignment system for aligning a side of a panel being installed on a building with an adjacent side of an already installed panel, the system comprising:

first and second panels, each panel having a respective front and back face, first and second sides, a top side, and a bottom side;

a first mullion guide attached to the first side of the first panel and comprising a body elongated along a first axis and having a respective top end and bottom end and defining a first axial channel between the top end and the bottom end, the first axial channel widening towards the top of the first mullion guide to form a first funnel portion;

a second mullion guide attached to the second side of the second panel and comprising a body elongated along a second axis and having a respective top end and bottom end, a bottom section of the second mullion guide defining a second axial channel, the second axial channel widening towards the bottom of the second mullion guide to form a second funnel portion;

the first funnel portion configured to capture at least a portion of the second mullion guide and the second funnel portion configured to capture at least a portion of the first mullion guide when the second mullion is positioned in a start position above the top of the first mullion guide and within a first horizontal tolerance range and then lowered alongside the first mullion guide to a first position;

wherein the first channel is operative to position a captured portion of the second mullion guide along an axis substantially normal to a face of the first panel, the second channel is operative to position a captured portion of the first mullion guide along an axis substantially normal to the second axis and substantially parallel to a face of the second panel, and the first and second channels operative to confine a horizontal position of the second mullion guide relative to the first mullion guide to within a second horizontal tolerance range smaller than the first horizontal tolerance range when the second mullion further lowered alongside the first mullion guide to a second position lower than the first position.

2. The system of claim 1, the first mullion guide comprising a respective base adjacent the first side of the first panel, first and second side walls extending outwards from the respective base, and a pair of opposing axial flanges extending inwards from the first and second side walls and defining the first axial channel;

the second mullion guide comprising a respective base adjacent the second side of the second panel, and an axial wall extending away from the respective base, the axial wall having first and second opposing sides, at least one respective guide block attached to the first side of the axial wall and defining the second axial channel adjacent the first side of the axial wall; and wherein at least a portion of the axial wall of the second mullion guide is captured in the first axial channel and one of the axial flanges of the first mullion guide is captured in the second axial channel when the second mullion is positioned above the top of the first mullion guide at the start position and the second panel is then lowered to the first position.

3. The system of claim 2, wherein the at least one guide block comprises first and second guide blocks each defining a respective side of the second axial channel.

4. The system of claim 3, wherein the first guide block and second guide block have different profile shapes as viewed perpendicular to the axial wall.

5. The system of claim 3, further comprising at least one respective guide block attached to the second side of the axial wall and defining a third axial channel in alignment with the second axial channel; the third axial channel widening towards the bottom of the second mullion guide to form a third funnel portion;

the third axial channel operative to capture the other one of the axial flanges of the first mullion guide when the second mullion is positioned above the top of the first mullion guide at the start position and the second panel is lowered to the first position.

6. The system of claim 1, the first channel extending substantially the entire length of the first mullion guide.

7. The system of claim 1, wherein the first mullion guide is slidably and removably attached to the first side of the first panel by a first track attached to the first side of the first panel and the second mullion guide is slidably and removably attached to the second side of the second panel by a second track attached to the second side of the second panel.

8. The system of claim 1, the top of the first mullion guide extending above the top of the first panel by a first distance, at least part of the first funnel portion positioned on the first mullion guide less than the first distance from the top of the first mullion guide, at least part of the second funnel portion positioned on the second mullion guide less than the first distance from the bottom of the second mullion guide.

9. A panel alignment system for aligning a side of a panel being installed with an adjacent side of an already installed panel, each panel having a respective front and back face, first and second sides, a top side, and a bottom side, a first mullion guide removably attachable to a first side of a first panel and comprising a body elongated along a first axis and having a respective top end and bottom end and defining a first axial channel between the top end and the bottom end, the first axial channel widening towards the top of the first mullion guide to form a first funnel portion;

a second mullion guide removably attachable to a second side of a second panel and comprising a body elongated along a second axis and having a respective top end and bottom end, a bottom section of the second mullion guide defining a second axial channel, the second axial channel widening towards the bottom of the second mullion guide to form a second funnel portion;

the first funnel portion configured to capture at least a portion of the second mullion guide and the second funnel portion configured to capture at least a portion of the first mullion guide when the second mullion is positioned in a start position above the top of the first mullion guide and within a first horizontal tolerance range and then lowered alongside the first mullion guide to a first position;

wherein the first channel is operative to position a captured portion of the second mullion guide along a first guide axis substantially perpendicular to the first axis, the second channel is operative to position a captured portion of the first mullion guide along a second guide axis substantially perpendicular to the guide axis, and the first and second channels operative to confine a position of the second mullion guide relative to the first mullion guide along the first and second guide axes to within a second horizontal tolerance range smaller than the first horizontal tolerance range when the second mullion further lowered alongside the first mullion guide to a second position lower than the first position.

10. The system of claim 9, the first mullion guide comprising a respective base adjacent the first side of the first panel, first and second side walls extending outwards from the respective base, and a pair of opposing axial flanges extending inwards from the first and second side walls and defining the first axial channel;

the second mullion guide comprising a respective base adjacent the second side of the second panel, and an axial wall extending away from the respective base, the axial wall having first and second opposing sides, at least one respective guide block attached to the first side of the axial wall and defining the second axial channel adjacent the first side of the axial wall; and wherein at least a portion of the axial wall of the second mullion guide is captured in the first axial channel and one of the axial flanges of the first mullion guide is captured in the second axial channel when the second mullion is positioned above the top of the first mullion guide at the start position and the second mullion guide is then lowered to the first position.

11. The system of claim 10, wherein the at least one guide block comprises first and second guide blocks each defining a respective side of the second axial channel.

12. The system of claim 11, wherein the first guide block and second guide block have different profile shapes as viewed perpendicular to the axial wall.

13. The system of claim 11, further comprising at least one respective guide block attached to the second side of the axial wall and defining a third axial channel in alignment with the second axial channel; the third axial channel widening towards the bottom of the second mullion guide to form a third funnel portion;

the third axial channel operative to capture the other one of the axial flanges of the first mullion guide when the second mullion is positioned above the top of the first mullion guide at the start position and the second panel is lowered to the first position.

14. The system of claim 9, the first channel extending substantially the entire length of the first mullion guide.

15. A construction method comprising the steps of:

accessing a building structure with a first panel mounted to an outer face of the building, the first panel having a top, a respective front and back face, first and second sides, a top side, and a bottom side, a first mullion guide being attached to the first side of the first panel and comprising a body elongated along a first axis and having a respective top end and bottom end and defining a first axial channel between the top end and the bottom end, the first axial channel widening towards the top of the first mullion guide to form a first funnel portion;

accessing a second panel having a top, a respective front and back face, first and second sides, a top side, and a bottom side, a second mullion guide being attached to the second side of the second panel and comprising a body elongated along a second axis and having a respective top end and bottom end, a bottom section of the second mullion guide defining a second axial channel, the second axial channel widening towards the bottom of the second mullion guide to form a second funnel portion;

positioning the second panel at a start position above and horizontally displaced from the first panel so that the top of the first panel is lower than the bottom of the second panel and the first side of the first panel is aligned with the second side of the second panel to within a first horizontal placement tolerance;

adjusting a horizontal position of the second panel relative to the first panel by lowering the second panel from the start position to a first position alongside the first panel wherein the first funnel portion captures at least a portion of the second mullion guide and the second funnel portion captures at least a portion of the first mullion guide; and confining the horizontal position of the second panel relative to the first panel to within a second horizontal tolerance range smaller than the first horizontal tolerance range by continuing to lower the second panel from the first position to a second lower position alongside the first panel wherein the captured portion of the second mullion guide is confined within the first channel and the captured portion of the first mullion guide is confined within the second channel.

16. The method of claim 15, wherein the top of the first mullion guide extends above the top of the first panel;

the step of adjusting the horizontal position of the second panel occurring before the bottom of the second panel is lower than the top of the first panel.

17. The method of claim 15, further comprising the steps of:

removing at least one of the first mullion guide from the first panel and the second mullion guide from the second panel after the second panel is in substantially its final desired position relative to the first panel.

18. The method of claim 15 wherein the first horizontal placement tolerance is at least 10 mm and the second horizontal placement tolerance is less than or equal to 3 mm.

19. The method of claim 15, wherein the first panel is attached to an outer face of a first prefabricated building module and the second panel is attached to an outer face of a second prefabricated building model to be placed in a building structure adjacent the first prefabricated building module;

the step of positioning the second panel comprising the step of lifting the second building module above and horizontally displaced from the first building module to position the second panel in the start position;

the step of adjusting a horizontal position of the second panel relative to the first panel comprising the step of lowering the second building module to move the second panel from the start position to the first position alongside the first panel; and the step of confining the horizontal position of the second panel comprising the step of lowering the second building module to move the second panel from the first position to the second lower position.

* * * * *